US007600460B2

(12) United States Patent
Manders

(10) Patent No.: US 7,600,460 B2
(45) Date of Patent: Oct. 13, 2009

(54) ON-SITE LAND MINE REMOVAL SYSTEM

(75) Inventor: Stephen M. Manders, P.O. Box 580205, Minneapolis, MN (US) 55458-0205

(73) Assignee: Stephen M. Manders, Minneapolis, MN (US)

( * ) Notice: Subject to any disclaimer, the term of this patent is extended or adjusted under 35 U.S.C. 154(b) by 328 days.

(21) Appl. No.: 11/430,774

(22) Filed: May 9, 2006

(65) Prior Publication Data

US 2009/0223355 A1 Sep. 10, 2009

(51) Int. Cl.
*B64D 1/04* (2006.01)

(52) U.S. Cl. ..... 89/1.13; 102/402; 86/50

(58) Field of Classification Search ..... 175/424, 175/67, 231; 137/801; 248/75; 251/155; 86/50; 89/1.13; 102/420
See application file for complete search history.

(56) References Cited

U.S. PATENT DOCUMENTS

| | | | | |
|---|---|---|---|---|
| 1,747,142 | A * | 2/1930 | Campbell | 89/40.03 |
| 2,249,373 | A * | 7/1941 | Alkan | 33/318 |
| 3,771,413 | A | 11/1973 | Sieg et al. | 89/1.13 |
| 3,800,715 | A | 4/1974 | Boller | 109/49.5 |
| 3,804,336 | A * | 4/1974 | Koeppe | 239/383 |

(Continued)

FOREIGN PATENT DOCUMENTS

| | | |
|---|---|---|
| DE | 39 28 082 A1 | 8/1988 |
| WO | PCT/US03/06174 | 2/2003 |
| WO | WO 03074961 A2 * | 9/2003 |

OTHER PUBLICATIONS

Sandia Science News, Jan. 1992, Water Jet System Could Deactivate Battlefield Land Mines, p. 1.

*Primary Examiner*—Michael Carone
*Assistant Examiner*—Samir Abdosh
(74) *Attorney, Agent, or Firm*—Mark A. Litman & Associates, P.A.

(57) ABSTRACT

A method of deactivating land mines buried in ground comprises projecting high-pressure water jets into ground, cutting through ground with the high-pressure water jets, and making at least one cut through a land mine or cutting through at least one land mine that had been under the ground, the cutting of the land mine reducing the performance of the land mine. The method may reduce the performance of the land mine by rendering the land mine inactive to normal detonation procedures for the land mine. To reach as many surface areas on the buried landmines, it is preferable that at least two high-pressure water jets are spaced apart are used to cut through the ground. The method may be practiced with the high-pressure water jet being carried on a vehicle and cutting is done in a line that is formed at least in part by movement of the vehicle over the ground while the high-pressure water jet is cutting ground. An apparatus for the reduction in effectiveness of land mines buried in ground may comprise a self-contained push-cart unit or a unit attached or attachable to a vehicle. A complete system could comprise a vehicle having a source of liquid, a high-pressure pump to move the liquid under high pressure, a nozzle directing a liquid jet path for the liquid, a support for the nozzle, abrasive delivery system, and nozzle being controllable to direct the liquid towards the ground while the nozzle is fixed relative to the vehicle.

20 Claims, 9 Drawing Sheets

U.S. PATENT DOCUMENTS 3,916,805 A 11/1975 Kalfadelis et al. ..... 110/345
4,008,644 A * 2/1977 Kayser ..... 89/1.13
4,046,055 A 9/1977 McDanolds et al. ..... 86/50
4,467,694 A 8/1984 Azulai et al. ..... 89/1.13
4,478,368 A 10/1984 Yie ..... 239/430
4,491,053 A 1/1985 Bar-Nefy et al. ..... 89/1.13
4,493,239 A 1/1985 Pedersen ..... 89/1.13
4,545,157 A 10/1985 Saurwein ..... 451/102
4,552,053 A 11/1985 Bar-Nefy et al. ..... 89/1.13
4,590,844 A 5/1986 Bar-Nefy et al. ..... 89/1.13
4,648,215 A 3/1987 Hashish et al. ..... 451/40
4,667,567 A 5/1987 Morimoto ..... 91/376 R
4,669,760 A 6/1987 Hashish et al. ..... 285/272
4,690,030 A 9/1987 Bar-Nefy et al. ..... 89/1.13
4,707,952 A 11/1987 Krasnoff ..... 451/75
4,723,387 A 2/1988 Krasnoff ..... 451/75
4,727,940 A 3/1988 Bar-Nefy et al. ..... 171/84
4,854,091 A 8/1989 Hashish et al. ..... 451/38
4,909,330 A 3/1990 Kasher et al. ..... 172/4
4,919,034 A 4/1990 Firth ..... 89/1.13
4,936,059 A 6/1990 Hashish et al. ..... 451/99
4,938,114 A 7/1990 Matthews et al. ..... 89/1.13
5,035,756 A 7/1991 Covino ..... 149/37
5,140,891 A 8/1992 Husseiny et al. ..... 86/50
5,170,946 A * 12/1992 Rankin ..... 239/590
5,189,243 A 2/1993 Hambric ..... 89/1.13
5,223,661 A 6/1993 Sabri ..... 89/1.13
5,307,272 A 4/1994 Butler et al. ..... 700/90
5,373,774 A 12/1994 Akbar ..... 89/1.13
5,434,335 A 7/1995 Brummond et al. ..... 588/314
5,434,336 A 7/1995 Adams et al. ..... 588/313
5,445,690 A 8/1995 Wulfman ..... 149/109.6
5,463,169 A 10/1995 Hebisch et al. ..... 588/316
5,516,971 A 5/1996 Hurley ..... 588/318
5,523,517 A 6/1996 Cannizzo et al. ..... 588/319
5,786,542 A 7/1998 Petrovich et al. ..... 89/1.13
5,869,967 A * 2/1999 Straus ..... 324/326
5,884,160 A 3/1999 Kanazaki ..... 455/413
5,892,360 A 4/1999 Willer et al. ..... 324/326
5,988,037 A 11/1999 Haughom et al. ..... 89/1.13
6,064,209 A 5/2000 Banerjee ..... 324/329
6,109,112 A 8/2000 Borza et al. ..... 73/661
6,232,519 B1 5/2001 Eidelman et al. ..... 588/320
6,280,302 B1 8/2001 Hashish et al. ..... 451/102
6,283,832 B1 9/2001 Shepherd ..... 451/40
6,298,763 B1 10/2001 Greenfield et al. ..... 89/1.13
6,681,675 B2 * 1/2004 Miller ..... 86/50
7,328,643 B2 * 2/2008 Goetsch et al. ..... 86/50
2004/0200341 A1 * 10/2004 Walters et al. ..... 89/1.13
2007/0039831 A1 * 2/2007 Townsend ..... 205/324
2007/0260378 A1 * 11/2007 Clodfelter ..... 701/48

* cited by examiner

ON-SITE LAND MINE REMOVAL SYSTEM

BACKGROUND OF THE INVENTION

This invention relates generally to neutralization of explosive devices, such as land mines, unexploded ordnance (UXO), bombs, and the like. More particularly, the present invention relates to a system for neutralizing an explosive device on-site with controlled collateral damage, the system including both neutralizing components, conveying components, sensing components, motivating components, and an integrated system.

Various explosive devices have been and may continue to be deployed around the world. These explosive devices are present in various forms and provide various threats to people, vehicles, livestock, and other property that may be near such explosive devices. For example, explosive devices may include anti-personnel or anti-vehicle land mines. In addition, unexploded ordinance (UXO) may be located near, and present a threat to, people and property. Examples of UXO include various ammunition such as aerial bombs, or shells, which may be armed but have not yet exploded. Unknown or unforeseen conditions may cause the UXO to explode inadvertently with potentially disastrous results.

In addition, various types of explosive devices, sometimes termed bombs, can be assembled and deployed in areas where an explosion could threaten people or property. For example, such a bomb may be formed and positioned by an individual in a public area of a city. Often the triggering parameters of such a bomb are either unknown and/or out of the control of authorities who would otherwise desire to disable the bomb. For each of the above-described explosive devices, it is desirable to disable the system to avoid inadvertent damage to nearby people and property.

One traditional method of disabling explosive devices is to disarm them. Disarming can entail the disconnecting of the detonator or triggering mechanism from the explosive charge. Unfortunately, the appropriate manner of such disconnection may be difficult to determine or difficult to implement, or both, resulting in a highly dangerous situation for the person disarming the explosive. Further, even after being successfully disarmed, the explosive charge may still pose a danger of explosion due to other known or unknown mechanisms. Therefore, the explosive charge must still be neutralized or otherwise disposed of.

Another traditional method of disabling an explosive device is removing and transporting the system to a location that poses less danger to people and property, and detonating the explosive device there. Unfortunately, the removal of the explosive device without detonation may prove to be impossible, impractical, or difficult. For example, during a removal attempt there may be an inadvertent explosion and damage to people and/or property. Further, even if the explosive device was successfully removed, an inadvertent explosion and/or damage may occur during transit of the explosive device to a desired detonation location. Finally, even if the explosive system is successfully removed and transported to a desired detonation location, the detonation may involve collateral damage at the detonation site or require the provision of an explosion-resistant container.

The explosive device can also be conventionally disabled by in-place detonation where the explosive charge is triggered to explode. This method is often practiced in the case of land mines. While the land mine is covered with soil, such mines can also be covered with foliage or other camouflage, or can be uncovered. Mines of this type can be mechanically or non-mechanically (e.g., influence-type) activated. An influence-type mine contains an explosive bulk charge that is triggered by non-mechanical external conditions. For example, such a mine can be triggered by the detection of a sufficiently large and sufficiently close metal object. In contrast, a mechanically activated land mine is triggered in response to mechanical application of a force to one or more parts of the land mine. The triggering device may include, for example, one or more plates supported by one or more springs. When a sufficient amount of pressure is imparted to the plates of the triggering device, for example due to a person or vehicle moving onto the portion of the ground surface directly above the triggering device, the plates can press down. Under certain predetermined conditions of pressure or time, a fuse within the triggering device can be initiated, which in turn detonates the bulk charge. The bulk charge can be formed of various materials such as trinitrotoluene (TNT), Composition-B, C-4, mercury fulminate, binary compositions, or some other explosive material.

An explosive charge is desirably disposed of at or near the ground surface. The explosive charge can be a conventional explosive that can be remotely detonated through known methods. Such conventional explosives can include TNT, Composition-B, or others such as dilute explosive tile (DET) available from SRI International of Menlo Park, Calif. As the explosive charge explodes, material and energy travel away from the explosive charge. As the material and energy from the explosive charge travel in the direction of and to the land mine, the land mine, and more particularly the bulk charge, may experience a particular peak pressure for a particular duration, both of which are sufficient to trigger and therefore explode the bulk charge.

Unfortunately, the effectiveness of an explosive charge formed of conventional explosives is strongly effected by how much material is between the explosive charge and the land mine. When underground, this amount can be characterized by the medium depth MD of the medium (here the ground or soil) between the explosive charge and the land mine through which the explosive material and energy travels. The effectiveness is also strongly affected by the type of the ground or other intervening medium between the explosive charge and the land mine. Also, the effectiveness is affected by the overall distance from the land mine to the explosive charge. For example, this distance is greater when there is more lateral offset between the explosive charge and the land mine, and increases when the explosive charge is exploded at larger heights above the ground surface.

Due to each of the foregoing factors, conventional explosive charges can be unreliable for neutralizing underground land mines with a medium depth (MD) of greater than thirty (30) centimeters. Also, because the land mine may be detonated by the reaction of the bulk charge itself, and not the triggering device, the effectiveness of the conventional explosive charge is affected by the particular type of bulk charge used in the land mine. More specifically, the effectiveness is influenced by the required peak pressure and or duration required for detonating the type of material that forms the bulk charge.

Instead of a conventional explosive, a shaped explosive charge can be used for in-place detonation of the land mine. The conventional explosive charge essentially explodes with material and energy directed substantially equally in all directions. In contrast, the shaped explosive charge can be configured such that when exploded, the material and energy (sometimes referred to as the "jet" and including hot molten material such as copper) are projected outward in one or more predetermined directions, with reduced or substantially no projection in other directions. Thus, the shaped explosive charge can be placed near or on the land mine, for example near or on the ground surface, and remotely detonated. Upon such explosion, the jet can project into the land mine with sufficient pressure and/or duration to detonate the bulk charge.

Another prior art method of in-place detonation involves explosively formed penetrators (EFP), or self-forging fragments. A detonating device can be disposed some distance away from the targeted land mine, for example, above the ground surface, and exploded. Upon such explosion, fragments and penetrators are formed and projected toward the explosive device. When the fragments and penetrators penetrate into the device bulk charge, they can produce the required peak pressure for the required duration to produce detonation of the bulk charge. Unfortunately, the effectiveness of the EFPs are strongly effected by the overall distance between the EFP device and the land mine, the amount and type of intervening material, and the type of explosive used for the bulk charge.

Therefore, it is desired to have an apparatus and method for neutralizing explosive devices that are more effective, are less sensitive to the medium depth MD, less sensitive to intervening obstacles, and less sensitive to the type of explosive material used for the bulk charge. Further, it is desired that such an apparatus and method disable the explosive device without necessarily exploding the bulk charge, thereby substantially avoiding collateral damage.

U.S. Pat. No. 6,298,763 describes a system for neutralizing a bulk charge of an explosive device including a reaction stake having a first end and a second end, and including a reaction initiation material that can facilitate non-explosive neutralization of the bulk charge of the explosive device. Also included is a deployment mechanism disposed near the first end of the reaction stake, and a penetrating tip disposed near said second end of said reaction stake. In some embodiments, the reaction initiation material can facilitate neutralization of the bulk charge when the reaction initiation material is burned. In particular, the reaction initiation material can include magnesium-Teflon, thermites, solid rocket propellant, and/or liquid rocket propellant. Another system for neutralizing a bulk charge of an explosive device includes an array device, and a plurality of individual neutralization systems supported by the array device. Further, each individual neutralization system includes a reaction stake having a first end and a second end, and including a reaction initiation material that can facilitate non-explosive neutralization of said bulk charge of said explosive device. The individual neutralization system also includes a deployment mechanism disposed near the first end of the reaction stake and a penetrating tip disposed near the second end of the reaction stake. In some embodiments, the reaction stake further includes a stake housing in which the reaction initiation material is disposed, and the stake housing has an egress hole proximate the reaction initiation material. In addition, the reaction stake can include an ignition system proximate the reaction initiation material. More specifically, the ignition system can include an ignition fuse and a primer cap. A method is disclosed for neutralizing a bulk charge of an explosive device including positioning a neutralization system relative to an explosive device that includes a bulk charge. The method also includes piercing the bulk charge with the neutralization system and bringing a reaction initiation material in contact with the bulk charge. This contact causes at least a portion of said bulk charge to be non-explosive. In some embodiments, piercing the bulk charge includes positioning at least a portion of the reaction initiation material within the explosive device and creating an initial gap between the reaction initiation material and the bulk charge. This initial gap reduces the probability of pressure build up that can cause the bulk charge to detonate before it is rendered non-explosive by the reaction initiation material.

One class of methods requires that the ordnance be taken to a central location for processing. For example, U.S. Pat. No. 5,434,335 discloses destruction of explosives and other 'energetic' materials by feeding a stream of the material with diluent into a high temperature bath of molten alkali metal or alkaline earth metal salt. Organic material is destroyed, and inorganic material is separately recovered from the salt. Other destruction methods are known for particular types of material. For example, U.S. Pat. No. 3,916,805 and U.S. Pat. No. 5,516,971 are directed to destruction of nitrogenous explosives, the former by controlled oxidation and the latter by digestion in aqueous caustic solution. U.S. Pat. No. 5,523,517 is directed to destruction of nitramine explosive by heating a mixture of such explosive with an aqueous dispersion of powdered metal that does not react with water. Examples of suitable metals include aluminum, zinc, manganese, and magnesium. Controlled combustion of selected combinations of materials is disclosed in U.S. Pat. No. 5,463,169. Treatment of explosive waste is carried out in a bed of granular material, such as sand. The 'energetic' material is ignited in the bed, and the granular material absorbs the force of any explosion, dampens the destructive power of propelled debris, and conveniently collects the unexploded debris.

As disclosed in U.S. Pat. No. 5,035,756, devices containing thermite (or Thermit®) mixtures have been used to burn vent holes into the propellant/motor portion of ordnance carried on, e.g., aircraft for the purpose of venting the propellant during a fire. Thus venting the propellant is meant to preclude excessive pressure and explosion of the propellant during such a fire. This patent is directed to a thermite composition comprising particular components intended to yield selected density, tensile strength, and elasticity characteristics.

Another class comprises methods that can be applied to either material in ordnance or only to the explosive material removed from the ordnance. One such method is disclosed in U.S. Pat. No. 5,434,336. Sulfur and the explosive material are heated in an oxygen-free atmosphere to a temperature above 110° C. for a time sufficient to degrade the material to non-explosive reaction products. When liquid sulfur is used and introduced to the reactor in a stream of solvent, particularly carbon disulfide, the UXO need not be dismantled before treatment. Use of a liquid sulfur stream is preferred with waxy or cast explosives, as the warm sulfur will soften the explosive and improve mixture thereof with the sulfur. However, in accordance with this method, an oxygen-free atmosphere must be maintained during the initial step. Then, thus-decomposed material is subjected to high temperature sulfur vapor to complete the destructive reaction.

U.S. Pat. No. 5,988,037 describes an apparatus for clearing land mines from below the surface of soil overgrown with vegetation and for rendering land cleared of mines suitable for agriculture or other use, said apparatus being mountable on a blast resistant vehicle that moves over the land along a line of movement, said apparatus comprising: at least one cylindrically shaped cutter member positionable ahead of the vehicle so as to precede the vehicle as the vehicle moves along the line of movement, said cutter member being rotatable about an axis normal to the line of movement of the vehicle; drive means for driving the cutter member to rotate about the axis of the member independently of any movement of the vehicle, said cutter member being driven at a peripheral speed of from 8 to 20 meters per second; means for mounting said cutter member on the front of the vehicle to lower the exterior of said rotating cutter member into the soil ahead of the vehicle to destroy the land mines and comminute vegetation into the soil as the vehicle moves along the line of movement; said cutter member being formed of a plurality of disks lying normal to the axis of said cutter member and spaced along the axis of the cutter member, the peripheries of said disks forming the exterior of said member, each of said disks of said cutter member having a plurality of cutting teeth circumferentially spaced along the periphery of the disk, certain of said teeth of each of said disks extending laterally from the disk toward an adjacent disk and into contiguity with similarly extending teeth of the adjacent disk so that the cutter member engages substantially the entirety of the swath of soil traversed by the cutter member during movement of the vehicle; and a shield interposable between said cutter member and the front of the vehicle for protecting the latter from debris discharged from said cutter member.

Another class of methods is directed to reformulation of the 'energetic' material. For example, U.S. Pat. No. 5,445,690 discloses a method for reformulating polymer and wax-bound explosives to improve brisance. Added materials can include oxidizer, plasticizer, and stabilizer.

None of the above-described methods is suitable for destruction or neutralization of UXO and mines in situ. Known methods of in situ destruction, primarily providing for physical impact on the mines are unsatisfactory.

In one class of such methods, mines and UXO's are destroyed after detection by detonating a small explosive charge placed in or projected to the vicinity of the object to be destroyed. Detonation of this small charge causes a sympathetic detonation of the object and thus neutralizes the mine or UXO. Alternatively, a plurality of objects to be destroyed are removed from the site and relocated into one area, then detonated. This method requires use of an explosive charge and personnel skilled in the use of explosives. It also requires accurate detection and safe removal of individual mines.

Another class of methods of neutralizing UXO's and mines include use of plows, rollers, or flails attached to an armored vehicle. For example, U.S. Pat. No. 3,771,413 discloses use of wheels mounted on a vehicle, such as a tank, to detonate pressure-activated land mines buried in the ground in the path of the wheels. This method is slow, as the area to be cleared typically must be traversed a plurality of times, typically with the top layer of ground scraped away (itself a costly and dangerous undertaking) between traverses; cumbersome, as the necessary equipment must be sturdy, yet transportable from site to site; expensive, as it requires equipment and trained personnel; tedious, as a grid or other manner of ensuring thorough coverage must be established and adhered to assiduously, and dangerous, as the object is to cause the mines and UXO's to detonate.

Another class of methods is directed to temporarily disabling mines and UXO's, typically by cooling them to a temperature at which it becomes inoperative. In U.S. Pat. No. 4,046,055, the case of the mine or UXO is penetrated so that liquid nitrogen can be injected therein. This method is unsatisfactory, as merely piercing the outside of the device may cause it to detonate. U.S. Pat. No. 3,800,715 discloses drawing a mine or UXO into a tubular shell, closing the ends, and introducing liquid nitrogen into the interior. This method is less than satisfactory because it requires that the explosive device be moved before it is made less dangerous. Whereas each of these methods requires that each object be treated individually, U.S. Pat. No. 5,140,891 discloses a method and apparatus for neutralizing mines and UXO's by spraying cryogenic material over the area to be cleared to render the materials at least temporarily inoperable. Ordnance removed by this method should be placed in liquid nitrogen as quickly as possible. This is a difficult method, with many potential side-effects (e.g., creating an oxygen deficient environment) and inefficiencies.

Another area-wide treatment is disclosed in U.S. Pat. No. 4,493,239. The area to be treated is infused with an electrolyte and subjected to a direct current voltage to enhance natural corrosion. The temperature of the area also may be increased, for example, by covering the area with black material, such as a plastic sheet, to further accelerate corrosion. This method is unsatisfactory because it takes on the order of five to ten years and requires continuing attention.

U.S. Pat. No. 6,232,519 describes a method of reacting on or near the surface of the mine or UXO a charge of a compound that reacts with an extremely high heat-release rate. The intense exothermic reaction generates high temperature combustion products that will melt, burn, or otherwise disrupt, a metal, plastic, composite, or wooden casing, thus leading to combustion or decomposition of the explosive. In an alternative embodiment, the high temperature in the casing decomposes the content thereof, causing the pressure in the casing to rise, fracturing the casing before the explosive detonates. In either case, the disrupted casing enables ignition of a large area of the explosive charge and provides easy access for atmospheric air to support active burnout of the explosive.

U.S. Pat. No. 6,109,112 describes a prodding implement for determining acoustic characteristics of objects comprising: an acoustically transmitting probe having a detecting end and a coupling end; an acoustic transducer having a first end, for generating an acoustic emission, and for receiving an acoustic wave and generating an electrical signal in dependence thereon; an electrically insulating acoustic coupler for operatively connecting the probe and the acoustic transducer including; a first receiving end for receiving the coupling end of the probe and having an internal probe contact surface for contacting the coupling end of the probe when received and lateral support means for surrounding a portion of the coupling end of the probe, a second receiving end for receiving the first end of the transducer and having lateral support means for surrounding portion of the transducer and an internal transducer contact surface opposite and acoustically contacting the internal probe contact surface; sealing means for contact between the coupling end of the probe and the internal probe contact surface and between the first end of the transducer and the internal transducer contact surface for acoustically transparent coupling of the coupling end of the probe to the internal probe contact surface and of the first end of the transducer to the internal transducer contact surface; and processor means for comparing known acoustic wave patterns to a received wave pattern, wherein acoustic coupling is provided over the internal probe and transducer contact surfaces, substantially without distorting acoustic wave transmission.

U.S. Pat. No. 5,892,360 describes a probe carrying vehicle is described which has at least one probe carrier which preferably carries at least one eddy current probe and at least one magnetic field probe for ground and foreign matter detection in a search area. Spacing means that may be in the form of a bogie assembly with wheels or chains or the like are provided to maintain spacing between the ground and the probes. The probe carrier is movable over the search area by means of a craft, to which the probe carrier is flexibly coupled by means of coupling means. The coupling means are disposed on one end of a preferably long pole, the other end of the pole being fixed rigidly to the probe carrier. The pole ensures a proper orientation of the probe relative to the ground particularly on uneven ground.

U.S. Pat. No. 5,884,160 describes a forwardly-rotatable, driven-drum, land mine clearing tool has a plurality of robust, easily-repairable tool spokes extending radially from the outer surface of the drum. The land mine clearing tool is connected to the front end of a tracked vehicle and is operatively raised and lowered from the tracked vehicle. The drum and tool spokes engage the earth of a land mine field in a milling action, which grinds and destroys some land mines while triggering detonation of other land mines.

U.S. Pat. No. 5,786,542 describes a system for clearing anti-personnel mines includes a vehicle, a blast shed on the front of the vehicle, and arms pivoted to the blast shield. A roller wheel subassembly is connected to the arms by cables or chains. Cross members fastened diagonally between the arms minimize side-to-side swing of the arms on the blast shield while allowing the arms to swing up and down relative to each other. The vehicle has a boom for lifting the arms and roller wheel subassembly. The arms connect to the boom by another chain or cable that slides through an eye on the boom so that the chain or cable accommodates relative vertical swing of the arms. The roller wheel subassembly has an axle and roller wheels on the axle, the inner diameter of the roller wheels being greater than the axle's diameter. Annular spacers on the axle alternate with the wheels, the spacer diameters being larger than the wheels' inner diameters but smaller than the wheels' outer diameters. The wheels and spacers move independently of one another rotationally and radially relative to the axle.

U.S. Pat. No. 5,373,774 describes a lightweight mine extracting plow is provided that can be mounted on any type of armored vehicle to enable the vehicle to cross minefields in an attack formation or to assist the armored vehicle in escaping from scattered minefields, either laid by air or by artillery, by removing obstacles, such as mines, from all areas of land. The plow has tines which penetrate the land to extricate the mines. Blades are shaped to dispose the mines sideways out of the path of the tracks of the vehicle. A folding skid device controls articulation of the plow over ground undulations and extends forward to assist in bridging ditches. The skid has a device which automatically positions it in front of the plow and overturns it into a pre-operation mode. A mechanical lifting device is operable by reversing the vehicle to lift the plow out of the ground. Thereafter, the device automatically reverts to its pre-operation mode. A locking device holds the plow in its pre-operation mode and allows it to drop to the ground when desired. A sliding bracket arrangement is provided such that the plow can be discarded by reversing the carrying vehicle.

U.S. Pat. No. 5,223,661 describes a system and process for neutralizing unexploded ordnances and clearing explosive infested areas such that maneuvers can be both readily and confidently continued without significant delay is disclosed. The system clears such unexploded ordnances infested areas by initially spraying the explosive infested area with a cryogenic liquid to neutralize the unexploded ordnances and reduce an output voltage of a detonator of the unexploded ordnances thereby rendering the unexploded ordnances inert, gathering the now unexploded ordnances and submerging the inert unexploded ordnances in a tank containing the same or similar cryogenic liquid so that the unexploded ordnances are maintained in a neutralized and inert state to allow for disposal. Alternatively, the neutralization of unexploded ordnance and clearing of explosive infested areas may be carried out by spraying the explosive infested area with liquefied methane to neutralize the unexploded ordnance and reduce an output voltage of a detonator of the unexploded ordnances to render such ordnance inert, igniting the liquefied methane, deflagrating the unexploded ordnances at a temperature less than that required for detonation and subsequently removing the neutralized ordnances from the explosive infested area.

U.S. Pat. No. 6,064,209 describes a two-step process for clearing unexploded ordnance ("UXO") from the ground. First a high power electromagnetic transmitter sweeps the ground area to be decommissioned. Secondly a lower-power time-domain electromagnetic transmitter or metal detector sweeps the same area to locate UXO. The high power transmitter employs a waveform of having the same frequency and pulse duration as that of the metal detector but does so with at least twice the power, Firstly, when the higher power waveform is applied to the ground, UXO which does not trigger and detonate or "function" is proved as non-functioning at lower detection power. Subsequently, the ground area can then be safely scanned by human personnel with impunity, applying the more accurate, lower power metal detector. The detected locations of unexploded ordnance are recorded for subsequent manual removal.

U.S. Pat. No. 5,307,272 describes a multi-sensor system for detecting the presence of objects on the surface of the ground or buried just under the surface, such as anti-personnel or anti-tank mines or the like. A remote sensor platform has a plurality of metal detector sensors and a plurality of short pulse radar sensors. The remote sensor platform is remotely controlled from a processing and control unit and signals from the remote sensor platform are sent to the processing and control unit where they are individually evaluated in separate data analysis sub-process steps to obtain a probability "score" for each of the pluralities of sensors. These probability scores are combined in a fusion sub-process step by comparing score sets to a probability table which is derived based upon the historical incidence of object present conditions given that score set. A decision making rule is applied to provide an output which is optionally provided to a marker sub-process for controlling a marker device to mark the location of found objects.

U.S. Pat. No. 5,189,243 describes a minefield clearing apparatus for attachment to a vehicle and having: an interface assembly for raising and shunting aside mines and other objects buried below the ground surface including: an articulated rake having a plurality of plow teeth which, in operation, extend below the ground surface; and a conveyor apparatus extending along the side of the vehicle and adapted to transport the contents of the earth raised by the articulated rake to the rear of the vehicle.

U.S. Pat. No. 4,467,694 (Azulai et al.) discloses a mine clearing apparatus having two widely spaced plow blades oriented so as to form a "V" and a frame mountable to a vehicle for selectable positioning in a raised or lowered orientation.

U.S. Pat. No. 4,491,053 (Bar-Nefy et al.) describes a minefield clearing apparatus mountable upon a vehicle having two widely spaced plow blades oriented so as to form a "V" and apparatus for automatically raising the plow from its lowered orientation to its raised orientation in response to backwards motion of the vehicle.

U.S. Pat. No. 4,552,053 (Bar-Nefy et al.) shows a minefield clearing apparatus mountable upon a vehicle having two widely spaced plow blades oriented so as to form a "V", such blades have two plow sections. An upper section moves soil, sliced by the teeth of the lower section, laterally.

U.S. Pat. No. 4,590,844 (Bar-Nefy et al.) discloses a minefield clearing apparatus for attachment to a vehicle having two widely spaced plow blades so as to form a "V" which may be raised or lowered automatically from inside the vehicle.

U.S. Pat. No. 4,667,567 (Schreckenberg) describes an apparatus for clearing light land mines provided with clearing elements which can freely move up and down independently of one another and which are disposed in a V-shaped movable carrier attachable to a vehicle.

U.S. Pat. No. 4,690,030 (Bar-Nefy et al.) provides a minefield clearing apparatus for attachment to a vehicle having two widely spaced plow blades oriented so as to form a "V" and being a continuation-in-part of U.S. Pat. No. 4,590,844.

U.S. Pat. No. 4,727,940 (Bar-Nefy et al.) discloses a tank mounted minefield clearing apparatus having a single plow section mounted parallel to the front of a vehicle and having a conveyor apparatus extending along the length of the plow section adapted to convey the contents of the earth raised by the plow section to one side of the vehicle.

U.S. Pat. No. 4,909,330 (Kasher et al.) describes an automotive earth moving vehicle for civil and military applications having a blade which is comprised of two horizontally linked segments adapted to alternate between a single plane dozer mode and a V-shape plow mode.

U.S. Pat. No. 4,919,034 (Firth) discloses a mine clearing apparatus having at least one plow blade and mounted in such a way that such a blade is pivotable about two axes. The preferred embodiment of the invention discloses an apparatus with two separate blades orientated in V-shaped fashion.

U.S. Pat. No. 4,938,114 (Matthews et al.) shows a mine clearing apparatus having float shoes that slide along the ground and adjust to maintain a chosen plowing depth. The float shoes are caused to move by powered adjusting means mounted upon a crossbeam and controlled by sensing means. The preferred embodiment of the inventive apparatus is provided with two blades oriented in V-shaped fashion.

Mine Clearance is one of the five core components of mine action. In its broad sense, it includes surveys, mapping and minefield marking, mine detection, mine education & awareness, medical assistance, relocation, etc. as well as the actual clearance of mines from the ground. This range of activities is also referred to as "demining".

Mine clearance is essential if communities are to regain full use of their land. In many situations mine clearance is a precondition for the safe return of refugees and people displaced by war from their homes, for the delivery of humanitarian assistance, as well as for reconstruction and sustainable development. Although mine clearance operations carried out to international standards are expensive, recent studies have shown that they not only allow for the social recovery of affected communities, but can also be justified on the basis of purely economic cost-benefit analysis.

Surveying, or the formal gathering of mine-related information, is required before actual clearance can begin. Impact surveys are intended to assess the level of socioeconomic impact of the mine contamination and to help assign priorities for the clearance of particular areas. Impact surveys make use of all available sources of information, including minefield records (where they exist), data about mine victims, and interviews with former combatants and local police, informants, and the community in general. Technical surveys then define the minefields and provide detailed maps for the clearance operations.

Maps resulting from the impact surveys and technical surveys are stored in the Information Management System for Mine Action (IMSMA), and provide baseline data for clearance organizations and operational planning.

Minefield marking is carried out when a mined area is identified, but clearance operations cannot take place immediately. Minefield marking, which is intended to deter people from entering mined areas, has to be carried out in combination with mine awareness, so that the local population understands the meaning and importance of the signs.

Clearance operations make use of three main methods:

- Manual clearance relies on trained deminers using metal detectors and long thin prodders to locate the mines, which are then destroyed by controlled explosion;
- Mine detection dogs, which detect the presence of explosives in the ground by smell. Dogs may be used in combination with manual deminers;
- Mechanical clearance using machinery, including flails, rollers, vegetation cutters and excavators, often attached to armored bulldozers, to destroy the mines in the ground. These machines can only be used when the terrain is suitable, and are expensive to operate. In most situations they are also not 100% reliable, and the work needs to be checked by other techniques.

Advances in technology have been made in recent years, both in mine detection systems and in mechanical means for destroying mines in place. However, in many situations manual clearance remains the preferred method, for reasons both of cost and reliability.

The UN bodies involved in mine action do not carry out mine clearance directly. In most countries they advise and assist the national authorities, or a UN peacekeeping mission, to establish a Mine Action Authority or Coordination Centre to oversee clearance activities. The actual clearance operations may then be carried out by national civilian agencies, military units, national or international NGOs or commercial organizations.

Existing technologies for tactical breaching include the M58A4 Mine-Clearing Line Charge (MICLIC), a rocket-propelled explosive line charge which basically blasts a vehicle width lane through a minefield. Another example of the line charge is the Antipersonnel Obstacle Breaching System (APOBS), The APOBS is a man-portable line-charge capable of blasting a footpath through a minefield. Other methods of breaching or clearing, essentially expanding footpaths created by a line charge, are through the use of plows, blades, rollers disks, and flails attached to a tank. Each of the methods described above was employed in Desert Storm, as was probing.

U.N. Clearance Standards

The United Nations provides a number of regulations and standards regarding the clearing and deactivation of mines 5.9 An area is cleared when all mines and munitions have been removed and/or destroyed. All debris, from mines and munitions, such as fusing systems, percussion caps and other items that constitute an explosive hazard, is to be removed.

5.10 The area should be cleared of mines and UXOs to a standard and depth which is agreed to be appropriate to the residual/planned use of the land, and which is achievable in terms of the resources and time available. The contractor must achieve at least 99.6% of the agreed standard of clearance. The target for all UN sponsored clearance programs is the removal of all mines and UXO to a depth of 200 mm.

Manual Clearance Tools 5.16 The following tools are used in demining operations with the objective of locating or assisting in the location of mines or munitions. Should any item be located, an immediate action (IA) drill must be known to all deminers.

a) Probing. The most commonly used method to check sub-surface for buried mines or munitions. Details of the angle and spacing for the use of the probe must be stipulated in the SOPs. See also Section One—Safety.

b) Excavation. An area where the detector or other methods have indicated the presence of metal will be excavated. Details of the depth, methods and tools to be used must be outlined in the SOPs.

c) Cutting tools. A variety of tools are available for the task of cutting small bushes, scrub and grass. All cutting tools must be used in the horizontal plane. Details of types and methods of use are to be outlined in the SOPs.

d) Metal Detectors. All detectors must be able to detect the landmines used in theatre to the depth of clearance specified. Consideration must be given to the depth of laying during operations and the end use of the land. All metal detectors need a comprehensive in-country technical evaluation. The SOPs must contain the procedures for operation, action on troubleshooting faults, maintenance and battery checking. The minimum depth of clearance is 200 mm therefore detectors should be able to detect mines to at least this depth.

e) Trip Wire Drills. A visual inspection is necessary in the zone that is being cleared. This may also be accompanied by a tripwire feeler drill. Methods of use are to be outlined in the SOPs.

Sandia, Inc. proposed in 1992 to provide a mobile vehicle that projected high pressure (10,000-60,000 psi) through water jets at the end of a long barrel to wash away dirt from mines and to cut through mines.

German Patent No. DE 39 28 082 A1 teaches the use of a motorized vehicle with separate water tank to provide a reticulating arm carrying a water nozzle to wash soil away from land mines. A sensor is used to detect mines and a gun is used to detonate the mines.

Applicant previously disclosed an effective land mine removal system in PCT Patent Application No.: PCT/US03/06174. This system has shown significant commercial potential, but can be improved upon.

SUMMARY OF THE INVENTION

High-pressure water jets are used directly against the ground to both remove surface cover of dirt and natural or applied cover over land mines or other buried explosives, and the high-pressure water jets also cut through the mines, mine fuses, or mine detonators, disabling them in many cases or causing them to explode in other cases. The water jets are preferably provided as a series of spaced apart nozzles (or jets as they are referred to). The nozzles are provided in a distributing that can be directed towards the ground (or in the embodiment where the device is used as a suspected container of explosive that is not on the ground or a wrecked vehicle from which persons are sought to be removed with minimal danger of igniting fuel) or towards the target to be cut. Generally for mine removal/detection/disarming, the nozzles should be capable of being directed downwardly (towards the ground) towards the path that is to be cleared of mines. The nozzles may be provided on a planar support surface (that is so that the ends of the nozzles are lying preferably along a plane so that they are equidistant from the ground. In other circumstances or methods of operating in the vicinity of mines, it can be desirable to have the nozzles presented towards the ground at different distances. For example, the nozzles most forward in the direction the system is moving may be elevated higher above the ground then the nozzles furthest from the direction of movement. In this way, the higher elevated nozzles may expose mines over a slightly wider area, and the lower height nozzles may focus their jets more intensely to slice through the mines. Looking at the face of a support for a multiplicity of nozzles, the nozzles may be seen to be positioned in a pattern or randomly as horizontally spaced apart nozzles. It is preferred to have spacing dimensions between nozzles that assure that even the smallest land mines will be cut by the water jets. The nozzles are relatively inexpensive and readily replaceable, so that in the event that any accidental detonation damages a nozzle, it may be readily replaced. The water jet system may also be extensible and may be moved horizontally in two dimensions (forward and back and also left to right). The device is preferably mounted on a vehicle or may be mounted on its own carriage. Many different liquids may be used, but water from available supplies and/or water laden or entrained with abrasive may also be used as the liquid emittent. The water need not be pure, and in fact the addition of abrasives to the liquids can be desirable. Some filtration may be desirable to assure that too large particles or stones from ambient sources of water do not enter the jet stream and clog the jets. The water jet system may be carried on a moving system such as a cart optionally fitted with motor, water storage, pumps, energy source or convertor.

There are three independent improvement elements provided that advance the technology over previous aspects. Hexagonal fluid conveyor pipes or tubes, especially when transmitting high pressure water (e.g., greater than 20,000 psi and/or with abrasive therein), reduce vibration of arms and water jet heads, increasing the efficiency of operation of the cutting. Gyroscopic stabilizers in the water jet heads reduce vibration of the water jet heads, increasing the efficiency of the cutting operation. The use of at least two forward-looking jet heads, elevated above the ground can be used to strip vegetation in advance of the mine-clearing device and actually increase the water use efficiency of the system in otherwise vegetation-restricted impenetrable areas.

DETAILED DESCRIPTION OF THE INVENTION

Figure 1:
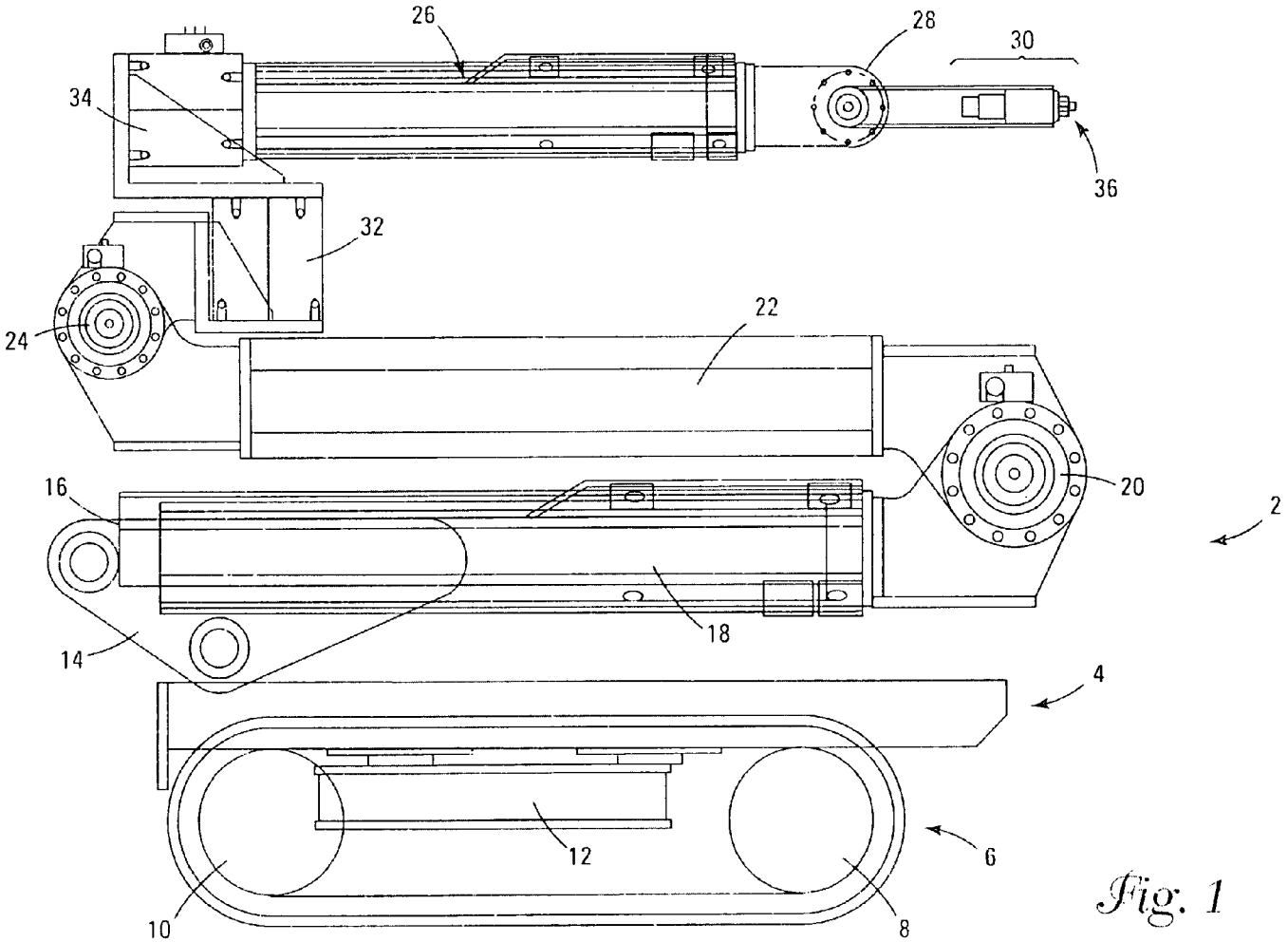
FIG. 1 shows both a side view of a folded water jet system for deactivating land mines but water jet cutting of the mines either on site or in situ.

A process for the in situ and on-site deactivation of land mines comprises at least one high-pressure water jet that is directed against the ground to remove cover from the land mine and (subsequently or simultaneously) cut through the land mine, deactivating the mine or reducing its effective capability. The water jet or a series of waterjets is moved over the surface area to be cleared of mines, tracing a path or series of paths that will intersect at positions that will overlap a high percentage of mines, hopefully one hundred percent of mines. If there is foreknowledge of the type of mines available or buried in an area to be cleared, the spacing or movement of the water jets may be tailored for those particular mines. If there is no basis for anticipating the specific type or size of mines present, the water jets may be spaced to assure contact with all known dimensions for mines, which is a minimum diameter of about 7.5 cm. Thus the water jets may be spaced at a minimum of 3 cm apart (center of jet to center of adjacent jet of adjacent path). The water jet (especially if there is a single row of jet nozzles) is moved at a sufficiently slow pace (e.g., 1 cm/sec or less) to assure that the volume and emission rate of the fluid from the jet will remove the cover from any mines and cut through the mine to deactivate or detonate the mine. The system may also be operated at a faster speed to uncover mines and then deactivate the mines by the same set of nozzles or with differentiated nozzles for exposing and then cutting the mines. Sensing systems (e.g., optical capture systems, scanners, cameras) may be used to convey images back to a control site so that the system needs to operate at a slower speed only after the mines have been exposed or sensed by the system or operator. The sensing system may be completely automatic with recognition technology used to identify a mine shape, may be completely under the control of a distal observer, using visual recognition to spot uncovered mines and direct the system (especially the later described robotic system), or a combination of computer observation and personnel observation. As the covering on mines tends to be of minimal structural importance, except for avoiding detection or providing shrapnel upon explosion, the water jets are generally able to cut through the mines rather easily, even when a composite or non-magnetically responsive metal cover is used. At an absolute minimum, mines may be clearly exposed by the water jet and then the water jet can be particularly positioned over the mine to cut through it, at whatever speed is needed to assure deactivation. The system can therefore both expose mines and deactivate them.

The spacing between water jets is most easily achieved by mounting a number of water jets (e.g., at least 2, at least 3, at least 4, at least 5, at least 6 and up to twenty or thirty or more water jets on a single support. A single or double set of water jets that are independently movable may also be provided to assure that if mine(s) are exposed but not detonated, a readily positionable set of water jet(s) or even single water jet may be positioned over the exposed and still active mine. At present, the preferred system uses between 5 and 20 jets, leaning towards the lower end to conserve water where that becomes a limiting factor (in the desert) in the continuous operation of the system. The relative position of the water jets on the support may be slidable, expandable, or otherwise readily adjustable to assure that appropriate spacing is effected. For example, expandable joints, accordion joints, slide joints, telescoping joints, and the like may be used to allow side-to-side spacing of the water jets to assure the proper spacing to deactivate mines.

The methods and apparatus of the present invention may be generally described as follows. A method of deactivating land mines buried in ground comprises projecting high-pressure water jets into ground, cutting through ground with the high-pressure water jets, and cutting through at least one land mine that had been under the ground, the cutting of the land mine reducing the performance of the land mine. The method may reduce the performance of the land mine by rendering the land mine inactive to normal detonation procedures for the land mine. It is preferable that at least two high-pressure water jets are spaced apart are used to cut through the ground. It is reasonable to use 2, 3, 4, 5, 6, 7, 8, 9, 10 or more individual jets in an array to practice the cutting effects of the invention. The jest may be in a single line or in a pattern designed to distribute the effect of the jets. The method may be practiced with the high-pressure water jet being carried on a vehicle and cutting is done in a line that is formed at least in part by movement of the vehicle over the ground while the high-pressure water jet is cutting ground. That is, the movement of the vehicle determines the primary movement of the nozzles at the ends of the device. Alternatively, the high-pressure water jet may be supported on a vehicle and cutting is done in a line that is formed at least in part by movement of an assembly supporting the water jet on the vehicle while the vehicle remains stationary. The vehicle may of course have the at least two high-pressure water jets that are spaced apart as part of the system used to cut through the ground. Reducing the performance of the land mine consists essentially of rendering the land mine inactive to normal detonation procedures for the land mine. By reducing the performance or capability of the landmine to normal detonation means that either the total explosive force capable of being provided by the land mine is reduced or the ease of detonation by a designed detonation system is reduced or deteriorated. It is preferred that the explosive device be rendered substantively inactive to pressure or influence detonation. However, the ability of the explosive charge to explode by heat, electrical charge, or collateral explosion need not be destroyed, which would require removal of the explosive material itself. It is a primary objective to remove the explosive capability of the mine, which is the major concern of land mines. Once the mine's functional capability of triggering has been degraded, manual removal upon observation of the mine becomes a much less dangerous and simple task. It is preferred that the high-pressure water jet has a pressure of at least 18,000 pounds per square inch.

An apparatus for the reduction in effectiveness of land mines buried in ground may comprise a self-contained push-cart unit or a unit attached or attachable to a vehicle. A complete system would comprise a vehicle having a source of liquid, a high-pressure pump to move the liquid under high-pressure, a nozzle directing a liquid jet path for the liquid, a support for the nozzle, and nozzle being controllable to direct the liquid towards the ground while the nozzle is fixed relative to the vehicle. Again, the at least two nozzles are provided on the vehicle so that they direct the liquid towards the ground while the at least two nozzles are fixed relative to the vehicle. By fixed, it is meant that the height and orientation of the nozzles is controllable and does not waiver so significantly with vehicle movement that the path of cutting cannot be controlled within the design parameters of the cutting/demining pattern. For example, the at least two nozzles are fixed at a distance of less than one meter from the ground (e.g., 1 m, 0.8 m, 0.75 m, 0.6 m, 0.5 m, 0.4 m, 0.3 m, 0.25 m, 0.2 m, 0.1 m, 0.05 m and the like. Extensibility of the nozzles from the vehicle may be effected at least in part by water carrying tubes that bend with respect to each other, as by using rotary actuators or telescoping tubes carrying the water. The moving cart may be positioned at a location and the arms carrying the jets may be articulated to sweep over an area at a constant height or controlled and variable height to sweep and uncover mines and to deactivate the mines.

Commercially available water jet systems and nozzles may be used. Cutting various materials by means of jets of high-pressure water is a well known technique in modern manufacturing engineering. Focused jets of high-pressure water from 2,000 pounds per square inch pressure ("psi") or less, up to 60,000 psi or more, are capable of cutting virtually any material. The term "high pressure" therefore means water pressure of at least 2,000 psi in the tip of the waterjet. Preferably the water pressure is at least 4,000 psi, at least 5,000 psi, at least 8,000, or more preferably at least 10,000 psi. Thick sheets of steel are capable of being cut by means of high-pressure water, as are much thinner sheets of soft or sticky material inconveniently cut by mechanical means. Cutting by means of water jets has several advantage including: sufficiently high quality cut providing for sharp inside corners, reduction in or elimination of slag or burr following the cutting operation (typically requiring a subsequent "deburring" operation following conventional cutting procedures), highly accurate contouring resulting in less wasted material, and water jet cutting allows the cut to be initiated at any point along the path to be cut on the workpiece.

The customary term in the field is "water jet cutting." However, abrasive additives may be added to the stream of water comprising the jet to increase cutting effectiveness (although wear on the nozzle is likewise increased). For the cutting of metals, abrasive grit is typically added to the stream after the jet is formed but prior to the impact of the jet on the workpiece. Water jets including abrasives can accomplish the cutting of intricate slots, through cuts and curves cut in metals, glass, stone, ceramics, artificial and natural abrasives, composites and similar materials.

Fluids other than water can also be employed if materials cannot be in contact with water but cutting with a jet of fluid is still the preferred cutting technique. For economy of language we will refer herein to "water jet cutting" or "high-pressure water" and the like, not intending to exclude cutting by jets of fluid other than water, and not intended to exclude jets of fluid containing abrasive or other additives.

The typical technique for cutting by means of water jets is to mount the piece to be cut (hereinafter "workpiece") in a suitable jig, die or other means for securing the workpiece into position. One or more water jets are typically directed onto the workpiece to accomplish the desired cutting, generally under computer or robotic control. The cutting power is typically generated by means of a single intensifier connected to the cutting head through high-pressure tubing, hose, piping, accumulators and filters. Typical units may have powers of at least 20 horsepower ("hp"), 50 hp, 250 hp up to 1000 hp.

The typical mode of water jet cutting is to employ a single water jet cutting head, but this is not an inherent limitation. A fine stream of water, typically traveling at two to three times the velocity of sound, is directed onto the workpiece. The stream of cutting fluid is typically pinhole size in diameter, but a jet slightly larger than (1/16) inch in diameter produces nearly 50 hp when concentrated. Hereinafter we will refer to workpiece and cutting tool in the singular, not intending thereby to exclude the use of a plurality of cutting heads and/or a plurality of workpieces.

Fluid-jet devices are often used to cut metal parts, fiber-cement siding, stone and many other materials. A typical fluid-jet cutting machine has a high-pressure pump to provide a high-pressure fluid source, and a nozzle is coupled to the high-pressure fluid source to generate a cutting-jet from the nozzle. The nozzle is also attached to a carrier assembly that moves the nozzle along a desired cutting path, and a catch tank is aligned with the nozzle throughout the cutting path. An abrasive particle source may be coupled to the nozzle to impart abrasive particles to the cutting-jet. The fluid is typically water, and the abrasive particles are typically garnet.

In operation of such a fluid-jet cutting machine, a workpiece is positioned between the nozzle and the catch tank. The carrier assembly moves the nozzle along the cutting path, and the high-pressure fluid source and abrasive particle source generate an abrasive cutting-jet projecting from the nozzle. As the cutting-jet passes through the work-piece, the catch tank receives the wastewater and abrasive particles of the spent cutting-jet. The abrasive particles generally accumulate in the catch tank, and the waste water generally flows out of the catch tank.

Waterjet systems are used for cutting many types of materials. A waterjet system includes a waterjet head that is supplied with liquid at an ultra-high-pressure (UHP), for example 10,000 to 60,000 pounds per square inch (psi) up to even 100,000 psi or more. The UHP liquid is discharged from the head in a high velocity stream against a workpiece. The liquid stream is used to cut through materials such as wood, paper and foam. An abrasive particulate material can be added to the stream, and the liquid/abrasive stream can be used to cut through composites, metals and other dense materials. The stream typically is concentrated in a small area, for example, for example as small as 0.05 inch diameter and has a high flow rate of perhaps one to three gallons per minute (gpm). Because of their high energy concentrations, such waterjet streams cannot be used for surface treatment operations such as cleaning, polishing or milling. A typical waterjet liquid or liquid/abrasive stream cuts too deeply and rapidly into the workpiece surface if it is stationary for even a small fraction of a second, and uniform surface treatment has not been possible. In the operation of the invention, as suggested earlier, water may be jetted at one pressure to uncover mines and then jetted at a higher pressure to cut through the mines. This would help conserve water, where that was an important factor.

Figure 8:
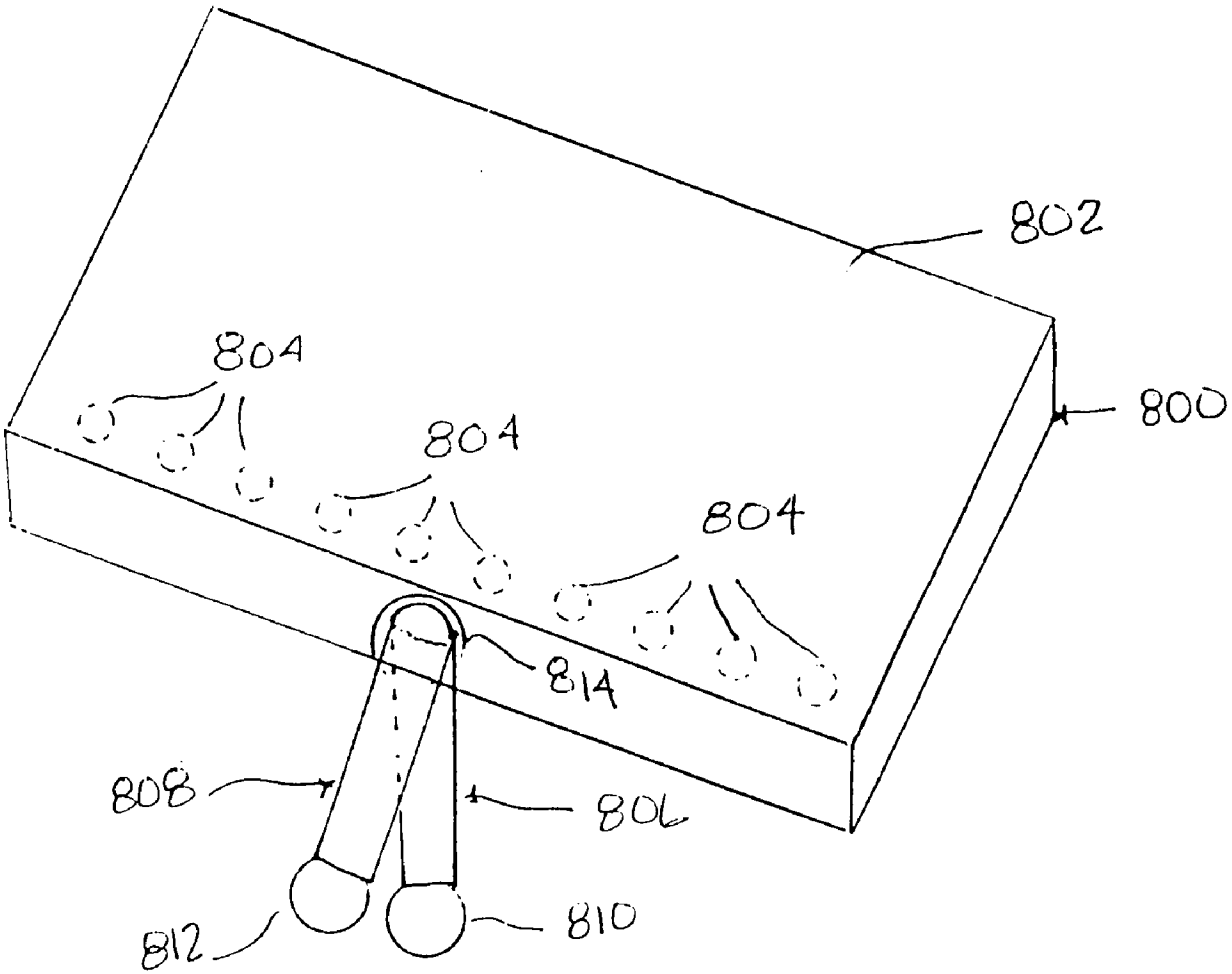
FIG. 8 shows a forwarding looking assembly carried by the moving system with multiple ground directed water jet heads and two rotating/oscillating forward-looking water jet heads.

A significant limitation in the ability of previously proposed land mine removal systems to effectively perform in the real world has been the fact that many mines are located in areas where there is significant vegetation cover in the area. This is particularly true with antipersonnel mines, which pose one of the greatest concerns. The image of the mines located only on roads or in fields ahead of advancing troops is erroneous. Not only are mines planted under grassland cover, but also in areas with taller, more deeply rooted vegetation such as bushes, shrubs and small trees. The bushes and shrubs and small trees provide a uniquely difficult problem. Even attempting to manipulate the taller vegetation can cause the root system of the taller vegetation to activate or detonate the land mines, so that even preliminary attempts at clearly an area of cover is dangerous. It has been found that the use of multiple (at least two) forward-looking water jets that can be projected forward and rotate to impact the taller vegetation at two levels above the ground can much more safely remove the vegetation by a combination effect of both cutting away the vegetation above the ground (by waterjet action) and my disrupting the root system (by water soaking and more steadily applied forces against the taller vegetation by the waterjet while the cutting is occurring. A non-limiting example of such a forward-looking system 800 is shown in FIG. 8, showing a forwarding looking support plate 802 assembly carried by the moving system (not shown) with multiple ground directed water jet heads 804 and two rotating/oscillating forward-looking water jet heads 812 and 810. Waterjet head 812 is supported on a column 808 that extends away from the support plate 802 at an angle that is elevated (farther from the horizon) as compared to the waterjet head 810 supported on column 806. This provides two waterjet heads that are forward looking and project water at two different angles in a forward looking direction. The two columns are shown on a swiveling support 814, which makes the two columns 806 and 808 rotate and change their elevation angles and respective elevations to provide a cutting action and tall vegetation dislocation force as the vehicle and the support plate 802 move forward, to bring the ground oriented waterjets 804 forward to be able to further expose and cut through land mines. The waterjet that is cutting at the more elevated angle (e.g., from an elevated position on the vehicle, the more elevated angle may still be downward) generally may be from about −30° to +60°, and the lower position of the lower waterjet may be from about −60° to about +45° at the same time as the position of the more elevated waterjet is concerned, remembering that the two waterjets 810 and 812 will exchange their relative positions.

The more elevated waterjet will tend to cut or shred upper levels of taller vegetation (usually at a point less than 2 meters above the ground) and the lower waterjet will tend to cut the taller vegetation off close to the ground, impacting the ground with water, softening the dirt and even cutting into and softening root structure. The pressure applied to upper portions of the vegetation during the cutting or shredding effect, places a leveraged force against the root structure in a more controlled and moderate manner that does plowing or pushing the taller vegetation, reducing the likelihood of premature detonation and assisting in loosening dirt from the roots and reducing the cover over the mines. This is a significant benefit over earlier versions of the system and enables use of the system in an area highly covered with vegetation. Although the two waterjets 810 and 812 are shown on a single rotating support 814, they may be provided on separate supports, adjacent to each other and the like, as long as at least one waterjet is rotated to provide the cutting action and the two waterjets, at various times, are aimed relatively higher and lower with respect to each other. Without the rotating motion, (motion in two dimensions), the cutting action of the forward-looking waterjets would be very limited.

It has been recognized that a continuously and rapidly moving, and accurately controlled, waterjet stream could be used for surface treatment operations if the energy dissipation could be uniformly spread over the workpiece surface area. However, there has been a longstanding and unsolved problem with providing an apparatus or method for achieving this result.

Waterjet systems normally incorporate a head drive arrangement, such as a computer numerically controlled (CNC) X-Y-Z drive system intended to move the waterjet head in a programmable pattern for making preprogrammed accurate cuts in a workpiece. These known drive systems cannot move the head continuously and quickly enough in a controlled fashion to carry out a satisfactory surface treatment operation without damaging the workpiece surface. Even with computer controlled motion and direction, a significant problem occurs because of intense vibrations that develop in the waterjet assembly, especially as higher water pressure is used and as abrasive material is added to the liquid stream passing through the waterjet. The vibrations occur at two distinct levels and for two similar but differently located positions in the system. The waterjet heads themselves vibrate, and the pipes or tubes carrying water (in the articulating arms, for example) separately vibrate. The vibration mechanism is not necessarily understood, but is definitely a function of the high pressure and the high flow rate of the liquid. The addition of particulates and abrasives in the liquid stream at these higher rates and pressures further exacerbates the vibration issue. Two separate, but combinable methods of reducing these problems have been found.

Figure 9:
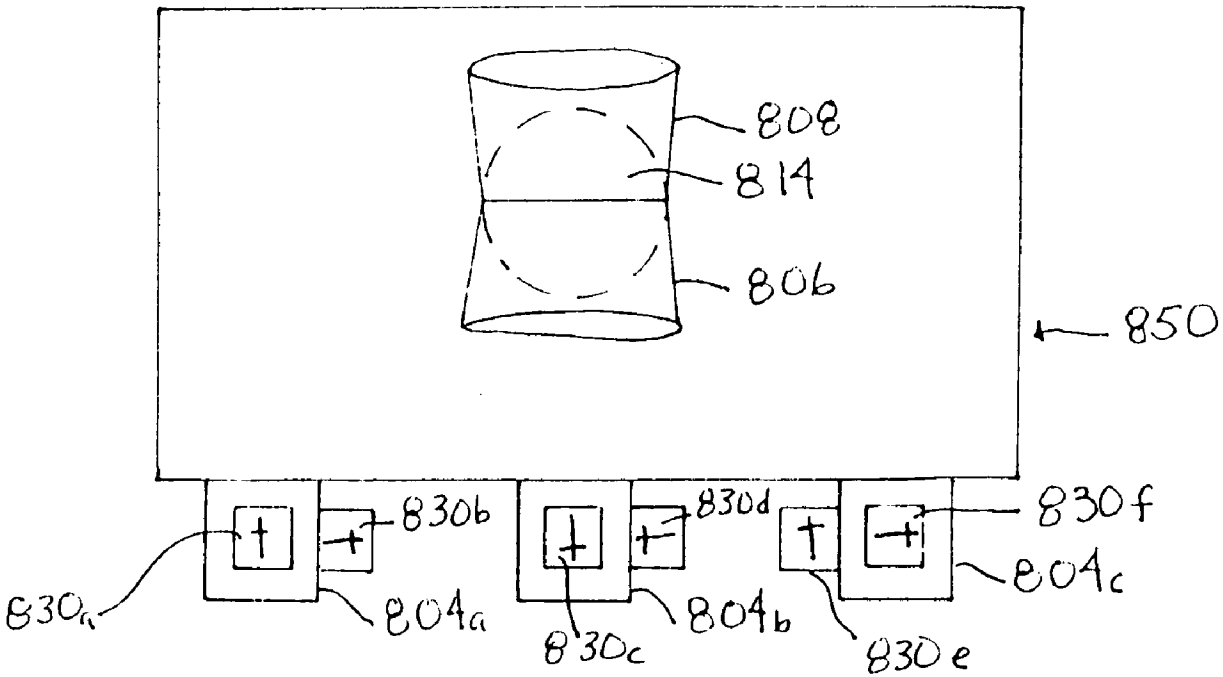
FIG. 9 shows a front view of a forwarding looking assembly carried by the moving system with multiple ground directed water jet heads and two rotating/oscillating forward-looking water jet heads and gyroscopic stabilizers on ground-facing water jet heads.

FIG. 9 shows a front view of a forwarding looking assembly 850 carried by the moving vehicle system (not shown) with multiple ground directed water jet heads 804*a* 804*b* 804*c* and two rotating/oscillating forward-looking water jet heads 896 808 and gyroscopic stabilizers 830*a* 830*b* 830*c* 830*d* 830*e* 830*f* on ground-facing water jet heads 804*a* 804*b* 804*c*. In each pair of gyroscopic stabilizers (830*a* 830*b*, 830*c* 830*d*, 830*e* 830*f*), the spin orientation of the gyroscopes in the pairs are to be essentially orthogonal to each other. That is, the axis of rotation (e.g., y axis) and the plane of rotation (e.g., x axis) for one gyroscope shall be paired with a second gyroscope having at least one of the axis of rotation or plane of rotation along the z axis. This is symbolically shown in FIG. 9. The various pairs do not have to be identically oriented, as also symbolically represented in the Figure. The gyroscopes may be electrically driven, pneumatically driven or gear driven. The gyroscope pairs restrain the vibration and therefore trajectory movement of the waterjet heads and therefore allow better focus of the waterjet stream. This makes the streams more efficient. This efficiency is not as important with the forward-looking waterjet heads, as the target (the vegetation) is more easily cut or shred, and the heads in that position are already moving in rotation. So the use of gyroscopes on those waterjets is optional or superfluous.

Figure 10:
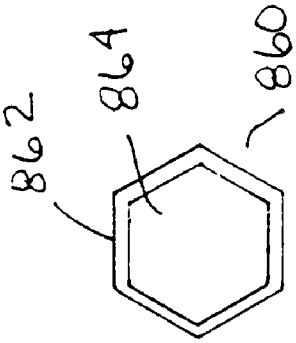
FIG. 10 shows a cross-section of a water carrying tube or pipe with hexagonal cross-section.

A second source of vibration that can be at least as disruptive of the efficiency of the waterjet head is vibration in the tubes or pipes (e.g., in the reticulating arms or telescoping arms). This vibration is again a result of the high pressure and the high flow rate through the tubes and pipes. FIG. 10 shows a cross-section of a water carrying tube or pipe 860 with hexagonal cross-section 864. The outer surface 862 is also shown as hexagonal, but it is primarily important that the flow of liquid through the interior be along a hexagonal surface. The hexagonal surface is preferably symmetrical and preferably normal (equilateral). Returning to FIG. 1, the various sections of pipes and fluid carriers denoted in or adjacent to the waterjet head 30, extending from articulation 34, intermediate pipes 18 and 22, and within the articulating joints themselves can be improved by using a hexagonal cross-section for the flow cross-section for the pipe or joint. The greater the length of existing length pipes that are hexagonal and the more numerous the hexagonal flow paths are, the greater the reduction in vibration.

In an attempt to solve this problem, it has been proposed to provide a waterjet head incorporating a discharge nozzle with an angled outlet passage and a swivel arrangement for rotating the nozzle. The intent of this approach is to provide a UHP stream that rotates at high speed to increase the workpiece surface area contacted by the stream and reduce the energy concentration of the stream. U.S. Pat. No. 4,669,760 discloses such a swivel fitting arrangement for a UHP liquid stream, and U.S. Pat. Nos. 4,854,091 and 4,936,059 disclose swivel assemblies for liquid/abrasive streams.

Prior art waterjet systems are commercially available from sources including EASB Cutting Systems, 411 Ebenezer Road, Florence, S.C. 29501-0504. A further description of the prior art system 10 can be found at the title pages and pages 2-4, 2-5, 2-7, 2-8, 2-12, 4-29, 4-30 and 2-24 through 6-26 of ESAB Cutting Systems manual No. F14-135 dated May, 1999, and incorporated herein by reference (and found in U.S. Pat. No. 6,283,832).

U.S. Pat. No. 6,280,302 describes a method and apparatus for controlling the coherence of a high-pressure fluid jet directed toward a selected surface. In one embodiment, the coherence is controlled by manipulating a turbulence level of the fluid forming the fluid jet. The turbulence level can be manipulated upstream or downstream of a nozzle orifice through which the fluid passes. For example, in one embodiment, the fluid is a first fluid and a secondary fluid is entrained with the first fluid. The resulting fluid jet, which includes both the primary and secondary fluids, can be directed toward the selected surface so as to cut, mill, roughen, peen, or otherwise treat the selected surface. The characteristics of the secondary fluid can be selected to either increase or decrease the coherence of the fluid jet. In other embodiments, turbulence generators, such as inverted conical channels, upstream orifices, protrusions and other devices can be positioned upstream of the nozzle orifice to control the coherence of the resulting fluid jet. For example, direct drive pumps capable of generating pressures up to 50,000 psi and pumps with intensifiers capable of generating pressures up to and in excess of 100,000 psi are available from Flow International Corporation of Kent, Wash., or Ingersoll-Rand of Baxter Springs, Kans.

Water jet cutting nozzles are well known in the art as disclosed in U.S. Pat. Nos. 4,545,157; 4,648,215; 4,478,368; 4,707,952 and 4,723,387. With each of these devices pressurized water and a stream of abrasive particles are introduced separately into the mixing chamber of a cutting nozzle. The high velocity jet of water comes in contact with the abrasive particles and momentum is transferred from the water to the particles to form a high velocity stream of abrasive particles entrapped within the stream of water that exits the cutting tip of the nozzle assembly. The abrasive water jet stream is then used in a variety of cutting operations, such as cutting rock, concrete, asphalt and metals such as reinforcing rod.

The system may be design as a push-cart system or as a system that may be installed on the front of a vehicle such as a car, truck, van, tractor, tank or other land vehicle. Larger vehicles are desired for improved stability. The water jet system may be provided in components such as single water jets, sets of water jet and the like, with a mounting system water flow system, control system (e.g., microprocessor, computer, software, sensors, and the like), abrasive addition controls, filter arrays, visual sensors to observe mines as they are exposed, sensors to identify malfunction of individual nozzles or tubes, flow control systems, self contained water systems, ambient water access systems (for accessing water from streams, seas, lakes, ponds, rivers, and the like), and other accessories as needed.

The nozzles may have openings conveniently sized to effect exposure and deactivation of the mines. The size of the jets exiting the nozzles may range, for example, from about 0.5 mm to 5 cm, although the higher dimension would require an inordinate fluid flow, so that more intermediate jet diameters, such as 0.5 mm to 1 cm, or 1 mm to 1 cm, or 1.5 mm to 1 cm, or 1.5 mm to 50 mm are particularly useful jet sizes, which tend to correspond to nozzle opening sizes (although jets may expand as much as 20% upon exiting nozzles, so nozzle sizes should be appropriately considered with regard to their dimensions). The liquid, as previously noted, may be stored water, ambient water, or any other available fluid, with water being the least expensive and most available liquid. Liquid alone may be used, or abrasive materials may be added to the liquid, usually by a separate addition system (that is, not stored with the water) such as a solids dispersing addition, addition of a concentrated dispersion of the abrasive, solids injection system into the water stream, etc. Sand is a convenient abrasive to be added to the fluid flow exiting the nozzles of the water jet, or more appropriately, the fluid jet. These and other aspects of the invention will be further described with reference to the Figures.

FIG. 1 shows a side view of a folded water jet system 2 according to one aspect of the invention. The water jet system 2 comprises a base 4 with a tread-based drive system 6 having wheels 8 and 10 that drive the treads or belt 6 and a droppable platform 12 that can stabilize the system 2 against undesired movement when in cutting mode. Support element 14 can swivel to assist in positioning the system 2. Water can be conveying into pipe opening 16 and moves through a first tube 18. The water is lead through the first tube 18 to a first rotary actuator 20 connected to a second water conveying tube 22. Water (not shown) carried within the second water conveying tube 22 is carried into a second rotary actuator 24 and then into a third water carrying tube 14. The water is then passed through the third rotary actuator 28 which can be used to finely direct the jet head 30. Water passes into the third water conveying tube 26 after passing through articulating water joints 32 and 34. The water passes from the third water conveying tube 26 into the water jet nozzle head 30. The water jet nozzle system comprises the nozzle 36, a rotating control element 28. Water exits out of jet nozzle 36.

Figure 2:
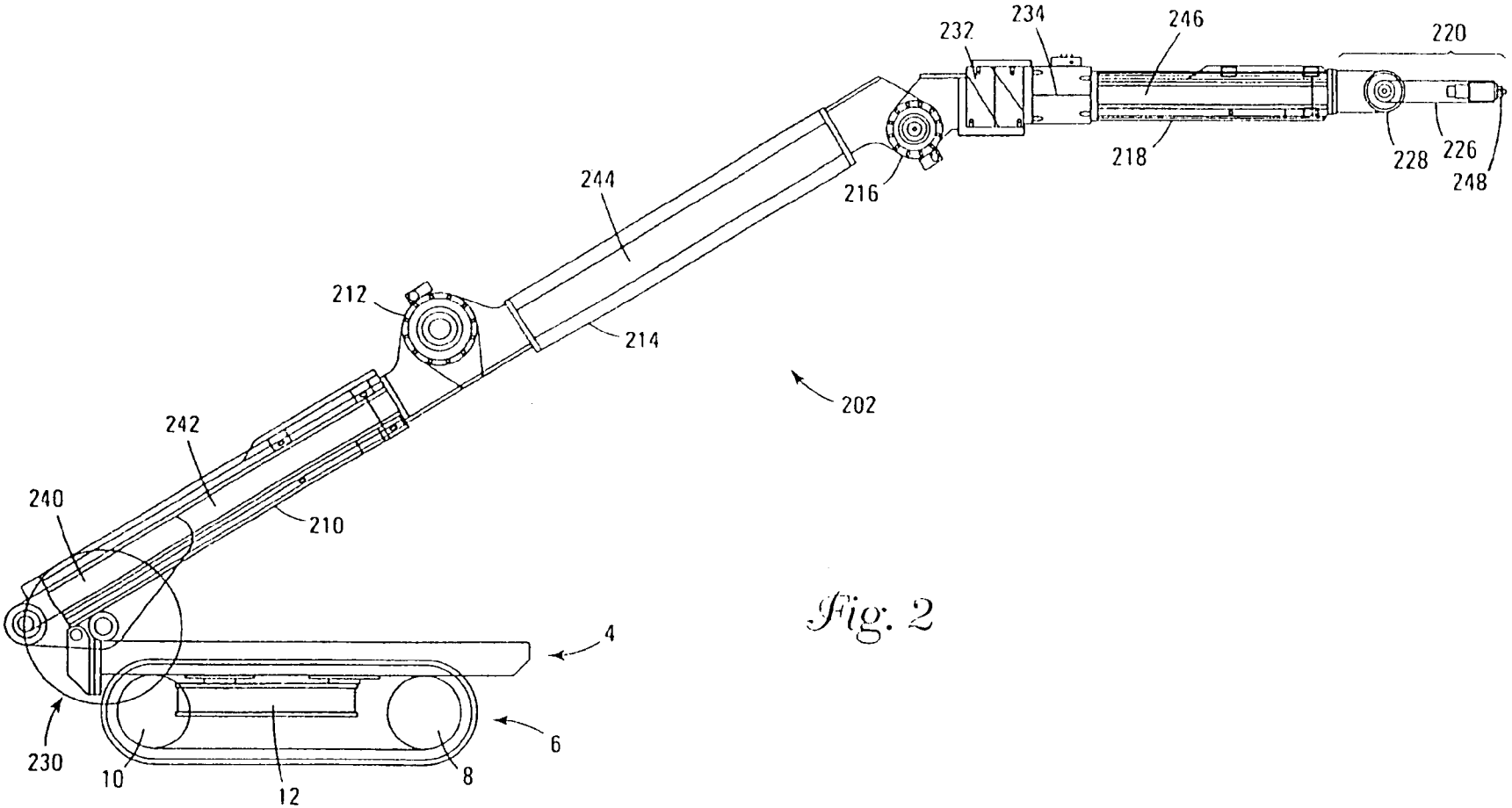
FIG. 2 shows a side view of a partially to completely extended water jet system for detecting and/or deactivating land mines by water jet cutting of the mines either on site or in situ.

FIG. 2 shows a partially extended water jet system 202 according to the present invention. The same elements of FIG. 1 are shown as a base 4 with a tread-based drive system 6 having wheels 8 and 10 that drive the treads or belt 6 and a droppable platform 12. Water (not shown) carried within the first water conveying tube 210 is carried into a first rotary actuator 212 and then into a second water carrying tube 214. The water is then passed through the second rotary actuator 216 and into the third water conveying tube 218. The water passes from the third water conveying tube 218 into the water jet nozzle system 220. The water jet nozzle system comprises the nozzle 228, a rotating control element 228 and a valve support element 226. Water exits out of the nozzle 248 of the jet nozzle system 220. The arc of rotation 230 of the support element 240 is shown. Water passes through the hollow portions 242, 244 and 246 of the system 2. Articulating water joints 232 and 234 are shown.

Figure 3:
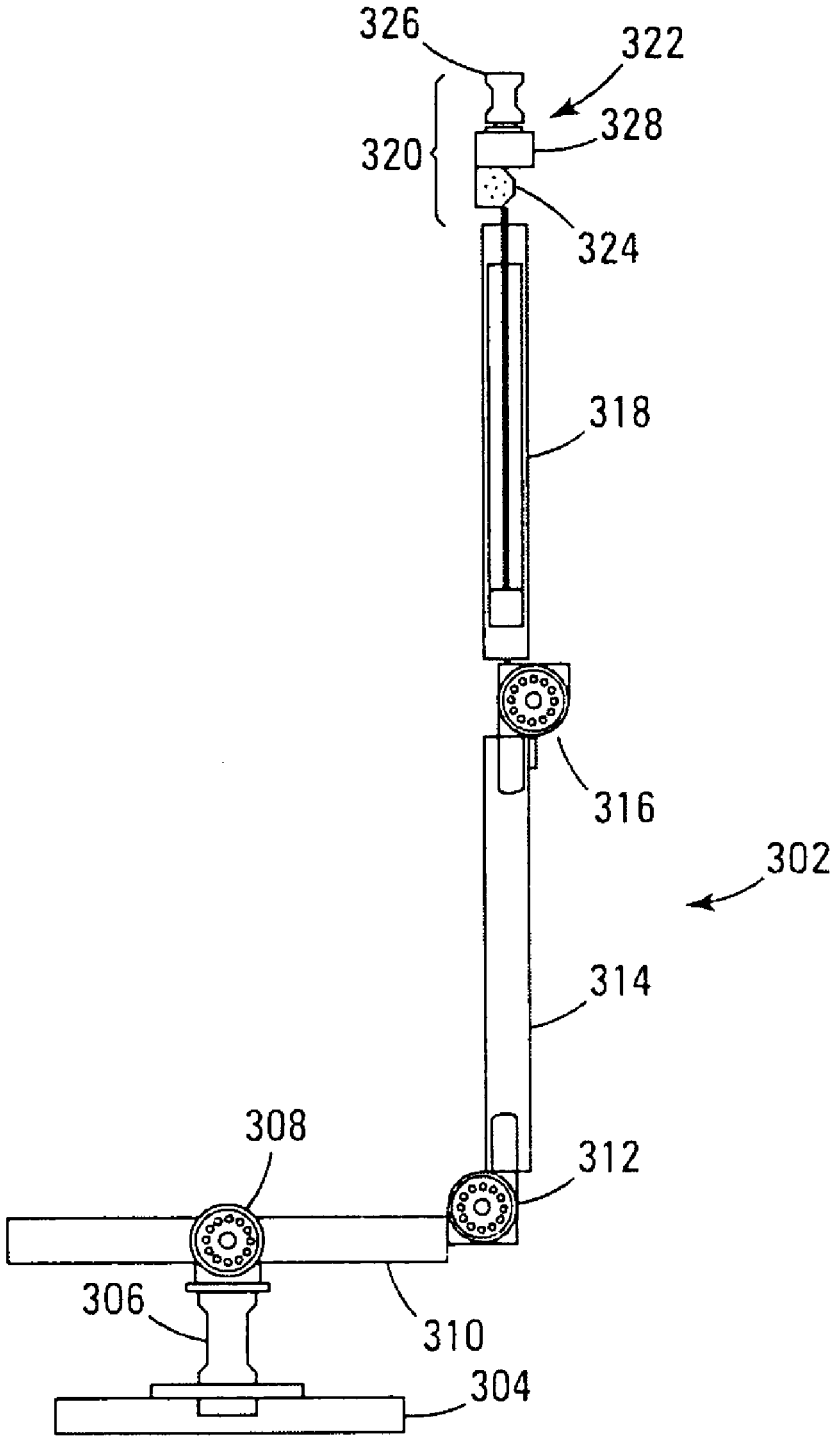
FIG. 3 shows a side view of a further partially extended water jet system for deactivating land mines or cutting through surfaces by water jet cutting of the mines either on site or in situ, the arm carrying the jet nozzle extended upwardly to reach an elevated target.

FIG. 3 shows a further partially extended water jet system 302 according to the present invention. The same elements of FIG. 1 are shown as a stationary base 304 with a water conveying valve 306 leading to a first rotary actuator 308 connected to a first water conveying tube 310. Water (not shown) carried within the first water conveying tube 310 is carried into a second rotary actuator 312 and then into a second water carrying tube 314. The water is then passed through the third rotary actuator 316 and into the third water conveying tube 318. The water passes from the third water conveying tube 318 into the water jet nozzle system 320. The water jet nozzle system comprises the nozzle 322, a rotating control element 324 and a valve support element 326. Water exits out of the emission surface 328 of the valve 322.

Figure 4:
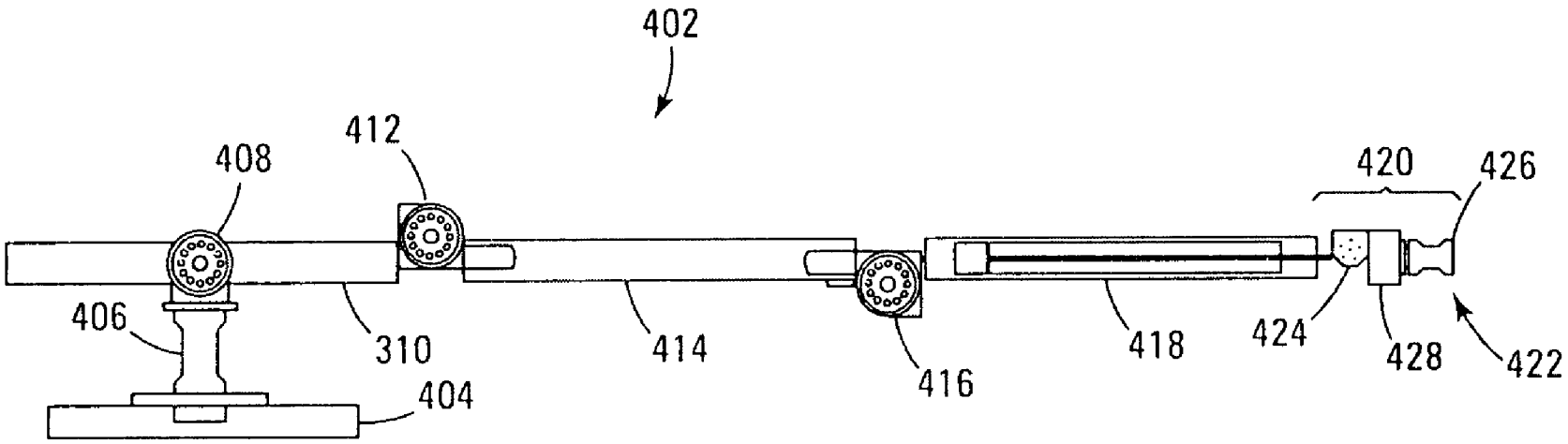
FIG. 4 shows a side view of a fully horizontally extended water jet system for deactivating land mines by water jet cutting of the mines either on site or in situ.

FIG. 4 shows a fully extended water jet system 402 according to the present invention. The same elements of FIG. 1 are shown as a base 404 with a water conveying valve 406 leading to a first rotary actuator 408 connected to a first water conveying tube 310. Water (not shown) carried within the first water conveying tube 310 is carried into a second rotary actuator 412 and then into a second water carrying tube 414. The water is then passed through the third rotary actuator 416 and into the third water conveying tube 418. The water passes from the third water conveying tube 418 into the water jet nozzle system 420. The water jet nozzle system comprises the nozzle 422, a rotating control element 424 and a valve support element 426. Water exits out of the emission surface 428 of the valve 422.

Figure 5:
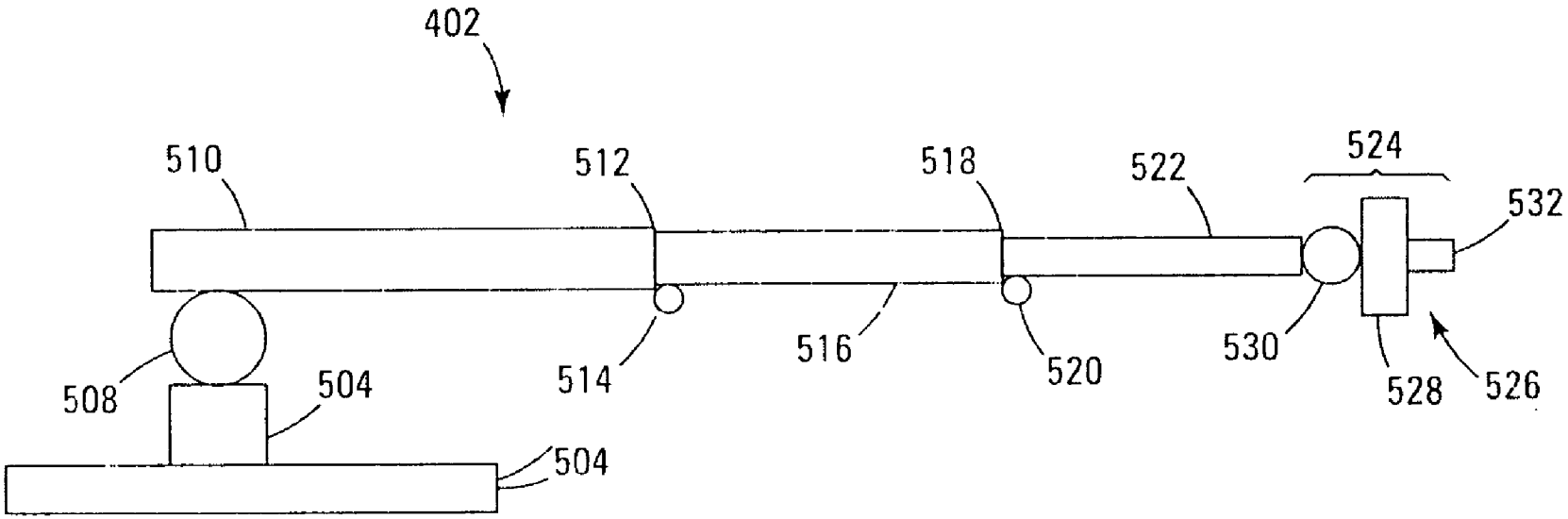
FIG. 5 shows an alternative side view of a telescopically extended water jet system for deactivating land mines but water jet cutting of the mines either on site or in situ.

FIG. 5 is a side view of a fully extended telescoping water jet system 502 for deactivating land mines but water jet cutting of the mines either on site or in situ. The telescoping system 502 comprises a stationary base 504 (the motorized base may also be used with this telescoping system), a water conveying element 506, a rotating water conveying connector or actuator 508 that is fluid conveying connected to first fluid (water) conveying tube 510. The first water conveying fluid tube 510 has a telescoping joint 512 that controllably extends second fluid conveying tube 516 by gearing 514. The gearing 512 is desirable to prevent high water pressure from extending the telescoping elements so strongly as to cause them to freeze or jam. The second fluid conveying tube 516 has a telescoping joint 518 that controllably extends a third fluid conveying tube 522 by a second set of gearing 520. At the end of the third fluid conveying tube 522 is a nozzle system 524 that comprises a rotating control element 530, the nozzle 526, and end support element 532. The nozzle 526 is shown with the fluid emitting surface 528 rotated towards a relatively downward position. The rotating water conveying connector 506 should have fairly complete rotational capability, such that the first water conveying tube 510 can be moved vertically and side-to-side to assure proper positioning. Only a single telescoping water jet element is shown, but in a preferred embodiment, sets of at least two, up to 10 or more such telescoping elements may be joined into a single unit. The individual telescoping units may be individually rotated to provide a control of the spread or separation of the individual nozzles at the ends of the units. Control of the position of the nozzles is preferably provided by computer control rather than manual control of each individual unit.

These waterjet detection and deactivation systems may be integrated into a completely integrated deactivation system. That integrated system may comprise a cart base on wheels. The cart base may support a water storage tank, an energy source (e.g., fuel burning system, battery system, solar powered system or other energy sources that may be used singly or combined) One particularly useful system is a diesel engine, which can use widely available fuels. This energy system powers a high-pressure pump. There would be a water source and a hose for carrying high-pressure water to the high-pressure directing robot subcomponent shown in FIG. 1. The water-cutting tips would then be directed towards an Identified Explosive Device (IED), or towards the ground in its detection/uncovering mode before deactivation. An optional abrasive hopper may be provided to feed abrasive to be mixed with water from the water storage tank before it is fed through the pump. An important attribute of this integrated system is that the high-pressure directing robot subcomponent is free of electrically motivated elements, and is operated by pneumatic controls, using minimal amounts of the water pressure for motivation force. The hose may also have pneumatic control hoses (not individually shown) associated with it, the pneumatic control hoses being connected to controls in the high-pressure directing robot subcomponent to control general movement, directional movement, arm movement, tip positioning, and other necessary controls for the operation of the high-pressure directing robot subcomponent. Also attached to the hose may be sensor connectors (not shown), such as optical fibers to connect to optical sensors, thermal sensors, or other sensing elements that may be positioned near, but not in front of the cutting tips. The sensors are positioned after the jets so that the area passed over by the jets can be viewed and to minimize collateral damage to the system should a mine explode under force of the jets. The absence of electrical components reduces the potential for vapors or other accessible explosive or flammable materials being detonated by electrical sparks or heat generated by electrical flow. This also makes the system highly desirable for cutting into vehicle wrecks or storage tanks or unidentified packages as ignition potential is minimized. The larger components of the system are segregated from the high-pressure directing a robot subcomponent onto a trailer or cart base. This structure allows for many different variations in system design and particularly allows for elimination of electrical components in the high-pressure directing robot subcomponent.

Figure 7:
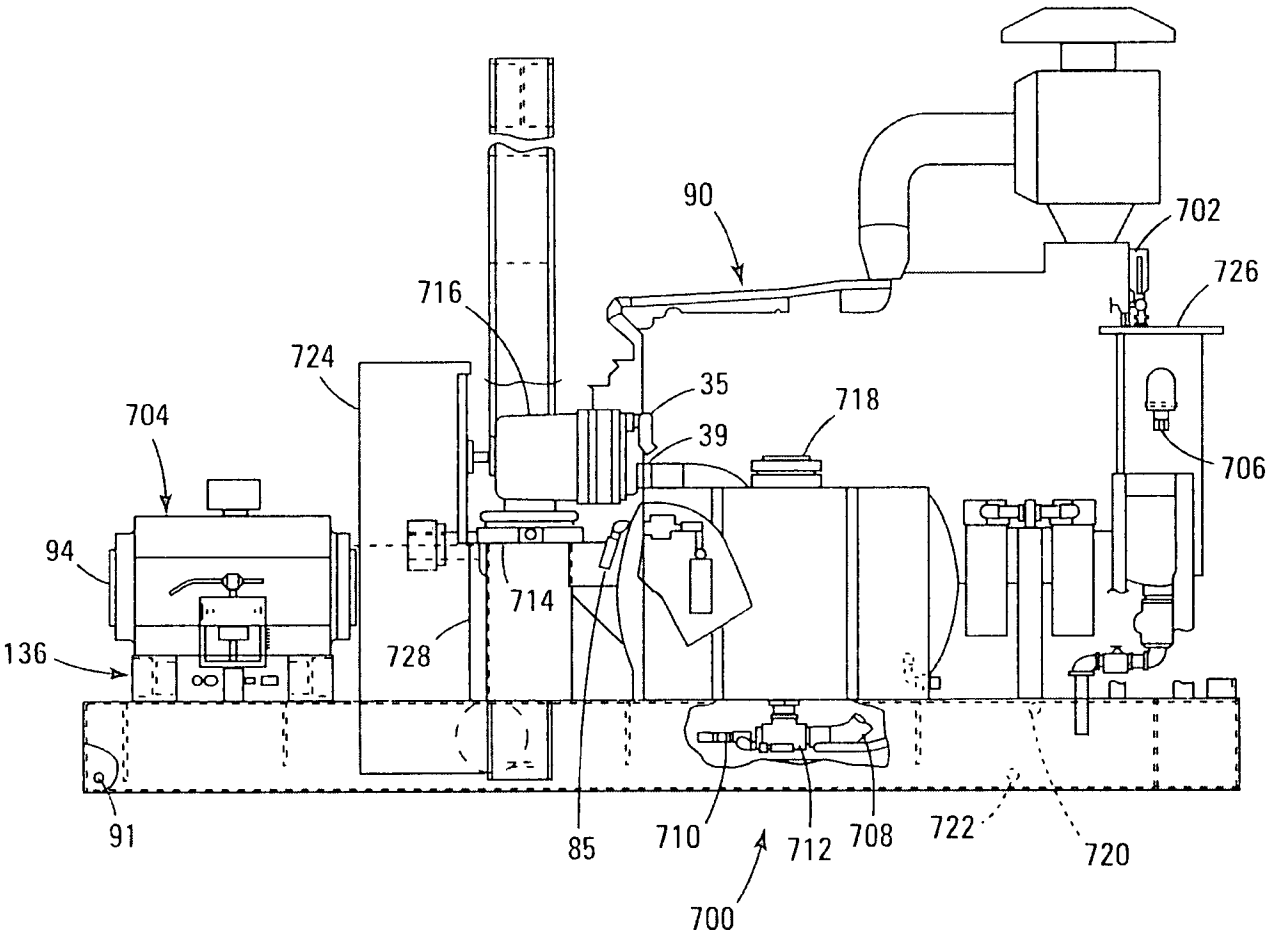
FIG. 7 shows a partial cutaway side view of a section of the power system for a land mine detection/deactivation system from the engine building water pressure to the pump for the water.

FIG. 7 shows a partial cutaway side view of a section of the system 700 from the engine 702 to the pump 704. FIG. 7 shows more detail in the system 700 such as a three-quarter inch (1.9 cm) garden hose connector 706, a 1.5 inch (3.8 cm) first hose assembly 710 to a charge dump (not shown), and a hose assembly 708 from the dump valve 712, a base for the motor slide 714, a self-priming diaphragm water pump 716, a thirty-five gallon (130 liter) water tank assembly 718, air hoses 720 and 722, a pad mounting assembly 724, water filter assembly 726, charge pump stand 728, and other recognizable features such as hose connectors and assemblies. Element 91 is an inlet tube for an outside source of liquid or gas. A pressure release vent 85, exhaust vents 35, and 39, housing cover 90, pump access port 94 are also shown.

Figure 6:
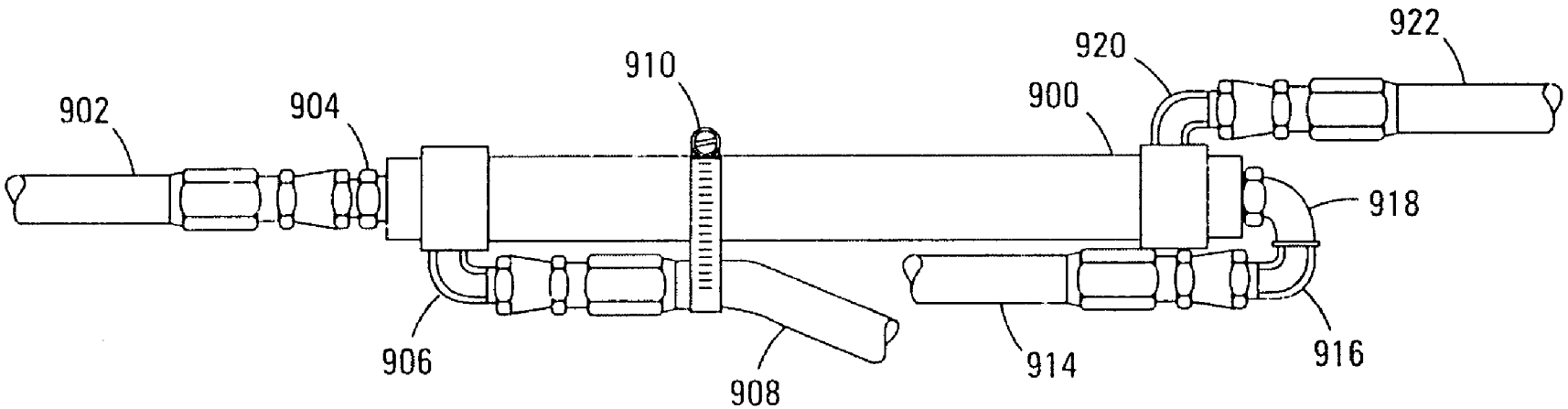
FIG. 6 shows details of a heat exchanger piping with tubing from a compressor (not shown) for fluid temperature control within a power system for the landmine detection/deactivation system of the invention.

FIG. 6 shows the details of the heat exchanger piping 900 with tubing 902 from a compressor (not shown), adaptor 904, adaptor elbow 906, hose assembly 908 from an air filter (not shown), hose clamp 910, heat exchanger 912, hose 914 to unloader valve (not shown) on top of air tank (not shown), elbow adaptor 916, reducing bushing 918, elbow adapter 920, and hose assembly 922 to the water storage tank (not shown).

The complete system may be taken to a potential operation site, with water fed from an outside source (where convenient) or carried to the site in a tank with supply capability (e.g., a water truck). The trailer (carrying the power system) is positioned at a respectful distance from the actual point of operation, and sufficiently close so that the robot pneumatic system can reach the unexploded device or other point of operation, yet the trailer (which may often carry fuel) is still sufficiently distant from the operation site so as not to be compromised if there is a mine detonation by the system. The robotic element is moved to a forward position at the site (with remote control preferred and with pneumatic control preferred) and moved into its initial position. The tips are appropriately directed, high pressure water sent through the tips, and the high-pressure water operation begun. Remote sensing should be used, as with optical fibers, cameras (either distal or proximal to the robot), infrared sensors, or the like to monitor the operation and local effects of the robotic system. The initial cutting operation I begun and by programming, manual remote control or a combination of the two, the cutting process is continued under distal direction, as from the trailer where controller personnel are located. In the event of a premature detonation or booby trap that cannot be addressed by the cutting device, personnel and the majority of the system is safe and the robot can be replaced.

There are numerous situations that can be addressed by the cutting system of the invention, either using a standard unit or with specialized units that can be modified at the site, in transit to the site, or at a central location. For a mine field, the robotic unit would be positioned at an edge position to the field, and then the robotic unit, with the high-pressure cutting tips aimed towards the ground, would sweep the area. A slight overlap in the sweeping path would be suggested, with the sweep speed (both mass movement of the robotic device and controlled movement of the tips on the extended arms in three dimensions) being controlled from the trailer (either by a processor and/or human controller) to effectively disarm individual mines in a sweep of the ground and progress over the field to deactivate all mines. By actually addressing the entire surface area of the field, all mines can be deactivated. The robotic device may move at relatively slow speeds in the process and its speed may be controlled. For example, when monitors show that no mine is present, the speed of the robotic element may be relatively fats (e.g., 3-5 centimeters per second or faster if the visualization, response and stopping capabilities are compatible with the higher speeds), and then the speed is slowed down to assure that the mines are cut through. Different mines require different degrees and times of cutting, so observed control is important. For example, plastic cover, composition cover or other non-metal covers can be cut through in a matter of seconds, while old fashioned, thick metal clad mines, may be cut at a rate of only millimeters per second (e.g., 0.1 to 10 mm/second or more or less as needed). Although these speeds are relatively moderate, the efficiency of the method, the safety of workers, and its speed compared to the presently most efficient process (the grunt groping on the ground with a probe) is a slower method, because speed cannot be altered without endangering the worker and reducing efficiency significantly.

Other site operations may be performed differently than with mine field clearance. For example, the cutting device may be used for victim extraction at a damaged site or wreck. The high-pressure water cutting system has a distinct advantage in wreck situations where drill or flame cutting devices cannot be used because of local fuel spillage. The device may be locally monitored under this situation, with an operator at the sire or distally located. The device I brought into a local position, small amounts of eater may be expelled from the tips (e.g., at high or reduced pressure) to assure correct targeting, and then high-pressure cutting is begun). All o fewer than all tips may be in operation, and the number of tips in operation may be modified during use. The cutting is performed on the wreck site and moved according to the local cutting needs.

With a possible toxic local site, evacuators may also be associated with the tips to vent any residue of toxic material at the site. This can be done through vacuum tubes or other venting systems in the distal end of the tube, adjacent the cutting tips. When toxic waste is encountered, the water may be temporarily cut off or pressure reduced to assist in removal of the toxic material without continuing to introduce water to the site. With cut off of the high pressure water, all vapors at the tip site can be influenced by applied vacuum or reduced pressure.

The tips of the high-pressure water cutting tips of the invention are preferably able to provide shaped jets of water, as with Rankin Shaped Jets® tips from Aqua-Dyne, Inc. Such jets are described generically in U.S. Pat. No. 5,170,946 for cleaning and cutting purposes. These Rankin-Shaped Jets® tips are disclosed as being capable of providing shaped water jets to assist in controlling cleaning and cutting parameters in high pressure systems. These tips are conventionally used in hand-held systems, with an operator holding the hand-held device and cutting or cleaning a surface under direct and close visual supervision by the operator. These tips provide high volume flow at high pressure such as at least 5 gallons/minute (18.52 L/minute) at pressures of at least 5,000 PSI, 8 gallons/minute (29.62 L/minute) at pressures of at least 7,000 PSI, 10 gallons/minute (37.04 L/minute) at pressures of at least 10,000 PSI, and 13 gallons/minute (48.13 L/minute) at pressures of at least 8,000, 10,000, or at least 12,000 PSI, with described conventionally used pressure of at least 40,000 PSI being shown. These tips are used in the industry as an environmentally friendly alternative to sandblasting or grinding; internal cleaning of pipes and heat exchangers, concrete removal; and as a cutting alternative to saw blades and laser cutting machines for parts fabrication. Hole diameters in the tips generally range from 0.001 to 0.071 inches (0.025 to 1.803 mm), although both larger and smaller holes may be used. The hole shapes are nominal in that shapes other than circular shapes with a constant diameter may be used. The holes may be slits (e.g., rectangles, narrow rectangles, pointed ovals, etc.), or polygon shapes, particularly triangles, equilateral triangles, isosceles triangles, irregular triangles, squares, etc. to provide an edge to the jet. The shaped jets also tend to maintain the jet in a cohesive stream for a longer emission distance than does a conventional circular hole in the jet tip.

The preferred tip available from Aqua-Dyne is a diamond hole tip, although the composition of the tip merely affects longevity of the tip and not its immediate performance. The tip is actually a small diamond (e.g., industrial or natural diamond) with a precision, shaped hole cut through the diamond. Other strong materials, e.g., tungsten carbide, metal alloys, etc.) may also be used, with the material merely controlling longevity and being an economic design choice.

The present invention also provides a core method for strategically neutralizing a potential bio-chemical weapon of mass destruction remotely while viewing and monitoring the procedure from a safe distance is the use of an ultra-high water jet in combination with an anti-bio-agent foam as developed by Sandia Labs. Once the bio-chemical target has been identified, it is surrounded with a dike or parameter to ensure that the foam and discharged water solution is kept in the immediate area. Then the weapon is rendered safe by the foam and water additives. This can be practiced, for example, as follows:

A pressurized canister device containing anti-bio-agent foam may be attached to the manipulator will be described. A delivery tube for foam dispersal runs to the end of the arm adjacent to the waterjet cutting tip. The arm is strategically aimed with the use of cameras (which may be positioned on the nozzle support or a water carrying tube that is aligned with the waterjet, or on a moveable camera) at a determined location on the suspected bio-chemical object, and the foam is remotely triggered until the object and the tip of the manipulator arm together are completely covered by a sufficient amount of anti-bio-agent foam. By foaming the entry site and the surrounding barrier with foam it is possible to contain any escaping hazardous materials. The water jet is activated while being entrained with a bleach solution, and breaches the casing of the target and vents the internal materials into the foam. The foam and solution kills or neutralizes the hazardous materials. The amount of total water-jetted solution introduced can be as little as 1 or two gallons. The device then can also be used to render safe any explosive device that may have acted as an accelerant or distribution method for propelling the hazardous materials into the environment.

In addition to the use of the waterjet system of the present invention, another component may be added to the system for use where there are biological issues or chemical issues with the targeted explosive or weapon. This is especially the case with low volatility materials that must be contained at site, as with anthrax powder, bacterial contaminants, dirty bomb material, and other hazardous material that can be accidentally present, incidentally present or intended to be present. This additional component or process involves the use of a second, relatively low pressure carrying tube to the point of application of the waterjet. The second carrying tube can apply a foam-in-place sealant to the target, allowing the waterjet to cut within the sealing foamed structure, preventing excessive release of the undesirable materials within the foam seal. There are commercial products available that can perform this task, such as the sealant of EnviroFoam Technologies which manufactures and distributes EasyDECON™ decontamination solution as a licensee of Sandia National Laboratories. EasyDECON (TMO decontaminaation solution is an optimized formulation of Sandia's original decontamination technology. Sandia National Laboratories Decon Formulation can be deployed as a foam, liquid spray, or fog. EnviroFoam Technologies Is a Licensed Provider of Sandia National Laboratories' Decontamination Formulation.

EnviroFoam Technologies along with Sandia National Laboratories has developed an enhanced version of EasyDECON™ 100 decontamination solution. EasyDECON™ 200 has proven to kill or neutralize a broad range of WMD warfare agents faster than EasyDECON™ 100, yet is less irritating to mucus membranes and remains environmentally friendly.

The binary blend of EasyDECON™ 200 has simplified the preparation and EasyDECON™ 200 can be ready for use in minutes. EasyDECON™ 200 Liquid Binary Blend consists of a liquid Penetrator, liquid Fortifier and a liquid Fortifier booster. In Sandia National Laboratories tests of Sandia National Laboratories Decon Formulation performance against chemical warfare (CW) agent simulants, half-lives for the decontamination of the simulants were on the order of minutes. Also, nuclear magnetic resonance (NMR) studies demonstrated that destruction of the CW simulants occurred without formation of potentially toxic byproducts. The simulant test results were confirmed by a facility licensed to perform live CW agent testing. The formulation was deployed as foam, and the half-lives for the decontamination of the live CW agents were on the order of 2 to 15 minutes. Live agent tests on three chemical agents (soman, VX, and mustard) and two biological agents (anthrax spores and *Yersinia pestis*) have shown the effectiveness of this sealant on biological contaminants.

There are several chemical and biological agents that can be reproduced and disseminated. The cost and availability of these agents make them difficult but not impossible to obtain. Some of these contaminants are fast acting and can cause widespread illness or death. EasyDECON™ 200 was designed to counter these contaminants as well. In several comparison tests using other decontaminants and EasyDECON, EasyDECON™ 200 proved extremely effective.

Mounted in front of the remote motorized tracks may be a hydraulic rack that is 10 feet long by 10 feet wide (3.1 m×3.1 m). A 12" (30.5 cm) row of 13 nozzles located in a straight row 1 inch (2.54 cm) apart moves from left to right beginning near the front of the tracks. It moves at the correct rate for 10 feet (3.1 m) to the other side of the rack to cut into the landmines in the soil below, thereby rendering them harmless. The arm then advance 12 inches (30.5 cm) forward and moves from right to left to repeat the process. This is done 10 times until the row of nozzles is at the front of the hydraulic rack. At this time the entire unit advances 10 feet (3.1 m), stops and repeats the process.

In the case of highly vegetated areas that are generally found in mine fields about 60% of the time, the following process occurs simultaneously as the entire unit moves forward. Two 4 ft. (1.4 m) to 6 ft. (1.9 m) arms in front of the hydraulic rack each has a rotary nozzle at the end that rotates on its arm or through its arm from 200 to 300 RPM containing more than one jet head, such as 2, 3, 4, 5 or 6 nozzle jets each. One arm points directly ahead horizontal to the ground, and the other points down at approximately a 45 degree angle. As these at least two forward-looking heads rotate, the arms may rotate independently, they may rotate in tandem, and/or the multiple jet heads may also rotate about each other on the head. The arms move together at a determined rate back and forth from one side of the front of the hydraulic rack to the other; from left to right or visa-versa. The straight arm completely obliterates any vegetation in its path while the angled arm penetrates to the necessary depth (8 inches to 24 inches; 20.3 cm to 61 cm) and destroys any roots while up-rooting and exposing any landmines. The surface ground is left amazingly dry. In the rare event that a mine is activated, it is sufficiently far enough from the shielded track system that little or no damage occurs.

In the case where small trees are in the way, sound detecting devices on the robotic track system cause the system to stop advancing, and the arms to automatically reverse immediately at the outer end of the tree. This process is repeated until the tree is mowed down.

As can be seen, the system of the invention has wide-ranging and alternative uses that are beneficial to public health and safety.

What is claimed:

1. A method of exposing and deactivating land mines that are covered by material including ground and vegetation comprising projecting high-pressure water jets into two distinct directions at various times in performance of the method, a first direction comprising at the ground material to remove at least some of the material and to expose a land mine, and cutting through at least one land mine that had been covered, the cutting of the land mine reducing the performance of the land mine, and the second direction being at vegetation that is at least in part above ground to provide a cutting action against the vegetation, the cutting action comprising swiveling a waterjet head in two directions to cut through vegetation.

2. The method of claim 1 wherein reducing the performance of the land mine consists essentially of rendering the land mine inactive to normal detonation procedures for the land mine.

3. The method of claim 1 wherein there are at least two swiveling waterjet heads aimed in the second direction so that the waterjets from the at least two swiveling waterjet heads do not intersect each other.

4. The method of claim 3 wherein during swiveling of the at least two waterjet heads, one waterjet head directs a waterjet stream at an angle that is elevated by at least 30 degrees above an angle of projection of a waterjet from another of the at least two waterjet heads.

5. The method of claim 3 wherein at least two high-pressure water jets directed in the first direction that are spaced apart are used to cut through the ground.

6. A method of exposing and deactivating land mines that are covered by material comprising ground by projecting high-pressure water jets from waterjet heads comprising orthogonally gyroscopically stabilized waterjets heads wherein waterjets are directed into two distinct directions at various times in performance of the method, a first direction comprising at the ground material from gyroscopically stabilized waterjet heads to remove at least some of the material and to expose a land mine, and cutting through at least one land mine that had been covered, the cutting of the land mine reducing the performance of the land mine, and the second direction being at vegetation that is at least in part above ground to provide a cutting action against the vegetation, the cutting action comprising swiveling a waterjet head in two directions to cut through vegetation.

7. The method of claim 1 wherein the high-pressure water jet has a pressure of at least 10,000 pounds per square inch.

8. The method of claim 6 wherein the high-pressure water jet has a pressure of at least 10,000 pounds per square inch.

9. The method of claim 1 wherein at least five nozzles with waterjet heads are provided that each direct high pressure water jets towards the ground material.

10. An apparatus for the reduction in effectiveness of land mines buried in ground comprising a vehicle having a source of liquid, a high-pressure pump to move the liquid under high pressure, a nozzle directing a liquid jet path for the liquid, a support for the nozzle and nozzle being directable to direct the liquid towards the ground while the nozzle is fixed relative to the vehicle, the nozzle having at least two gyroscopes stabilizing the nozzle against vibration wherein at least two gyroscopically stabilized nozzles are provided on the vehicle so that they direct the liquid towards the ground while the at least two nozzles are fixed relative to the vehicle.

11. The apparatus of claim 10 wherein the at least two nozzles can be fixed at a distance of less than one meter from the ground while they provide high-pressure water jet has a pressure of at least 10,000 pounds per square inch.

12. The apparatus of claim 9 wherein the pump is able to provide a pressure of at least 10,000 pounds per square inch in each water jet with waterjet streams from each nozzle not vibrating more than 0.5 cm out of alignment at a distance of 10 cm from an emission point from the nozzle.

13. The apparatus of claim 9 wherein there at least two nozzles are attached to a support on a front end of the vehicle and the at least two nozzles are able to rotate while retaining a forward-projecting orientation from the vehicle to be able to cut vegetation above ground in front of the vehicle.

14. The apparatus of claim 9 wherein extensibility of the nozzles from the vehicle is effected at least in part by water carrying tubes that bend with respect to each other.

15. The apparatus of claim 14 wherein at least some water carrying tubes have an internal flow path for the water that is hexagonal in cross-section.

16. The apparatus of claim 15 wherein the tubes bend with respect to each other through rotary actuators.

17. The apparatus of claim 14 wherein the nozzles are extensible from the vehicle at least in part by telescoping tubes carrying water.

18. The apparatus of claim 14 wherein the apparatus comprises a remote controlled movable carrier, an intake for high pressure liquid, an adjustable carrying arm that carries high pressure water, a water emitting tip, the carrying arm carrying high pressure water to the water emitting tip, and a viewing system to enable remote observation at a cutting site.

19. A method of cutting through surfaces while minimizing a risk of igniting flammable materials comprising directing the movement of the apparatus of claim 16 with the high pressure waterjet into position near a target having a surface to be cut, aiming the high pressure water jet at the surface by remote control, and projecting high-pressure water jets into the surface with the high pressure liquid to cut the surface.

20. The method of claim 19 wherein there at least two nozzles not directed vertically towards the ground that are attached to a support on a front end of the vehicle and the at least two nozzles rotate while retaining a forward-projecting orientation from the vehicle to cut vegetation above ground in front of the vehicle.

* * * * *